US011549408B2

(12) United States Patent
Oikawa et al.

(10) Patent No.: US 11,549,408 B2
(45) Date of Patent: Jan. 10, 2023

(54) IRON-BASED SINTERED ALLOY VALVE SEAT FOR INTERNAL COMBUSTION ENGINE

(71) Applicant: NIPPON PISTON RING CO., LTD., Saitama (JP)

(72) Inventors: Ayato Oikawa, Tochigi (JP); Kiyoshi Suwa, Tochigi (JP); Katsuaki Ogawa, Tochigi (JP); Hiroshi Oshige, Tochigi (JP); Kenichi Sato, Tochigi (JP)

(73) Assignee: NIPPON PISTON RING CO., LTD., Saitama (JP)

( * ) Notice: Subject to any disclaimer, the term of this patent is extended or adjusted under 35 U.S.C. 154(b) by 102 days.

(21) Appl. No.: 17/054,840

(22) PCT Filed: May 14, 2019

(86) PCT No.: PCT/JP2019/019080
§ 371 (c)(1),
(2) Date: Nov. 12, 2020

(87) PCT Pub. No.: WO2019/221106
PCT Pub. Date: Nov. 21, 2019

(65) Prior Publication Data

US 2021/0215071 A1 Jul. 15, 2021

(30) Foreign Application Priority Data

May 15, 2018 (JP) ..... JP2018-093627
Feb. 4, 2019 (JP) ..... JP2019-017607

(51) Int. Cl.
*F01L 3/02* (2006.01)
*B22F 5/00* (2006.01)

(52) U.S. Cl.
CPC ..... *F01L 3/02* (2013.01); *B22F 5/008* (2013.01); *B22F 2301/35* (2013.01); *F01L 2301/00* (2020.05)

(58) Field of Classification Search
CPC . F01L 3/02; F01L 2301/00; F01L 3/04; F01L 3/22; B22F 5/008; B22F 2301/35
See application file for complete search history.

(56) References Cited

U.S. PATENT DOCUMENTS 4,424,953 A * 1/1984 Takagi ..... F01L 3/02 123/188.8
2007/0101964 A1* 5/2007 Morimoto ..... B22F 5/008 123/188.8

FOREIGN PATENT DOCUMENTS

CN 1902381 A 1/2007
JP 50-7918 1/1975
(Continued)

OTHER PUBLICATIONS

International Search Report for PCT/JP2019/019080 dated Jul. 23, 2019, 3 pages.
Written Opinion of the ISA for PCT/JP2019/019080 dated Jul. 23, 2019, 5 pages.
Extended European Search Report issued in European Patent Application No. 19804252.5 dated Jan. 4, 2022.
(Continued)

*Primary Examiner* — Jacob M Amick
(74) *Attorney, Agent, or Firm* — Nixon & Vanderhye

(57) ABSTRACT

Provided is a valve seat insert for an internal combustion engine, which has both an excellent heat dissipation property and excellent wear resistance. The valve seat insert for an internal combustion engine is used while being press-fitted into an aluminum alloy cylinder head, is made of an iron-based sintered alloy, is formed by integrating two layers of a functional member side layer and a supporting member side layer, and has a plating film on at least an outer peripheral side. The plating film is preferably a copper plating film. The plating film is a plating film having a thickness of 1 to 100 μm and a hardness of 50 to 300 HV, and
(Continued)

the hardness of the plating film is adjusted so as to satisfy a range of 1.05 to 4.5 times hardness of the cylinder head in Vickers hardness HV. Pores contained in the valve seat insert are preferably sealed with a curable resin before plating treatment. Consequently, a valve seat insert for an internal combustion engine which does not go through complicated processes, is not accompanied by a significant decrease in wear resistance compared with the prior art, and has an excellent heat dissipation property is provided. If a roughened surface region is further formed at at least one portion on the outer peripheral surface of the valve seat insert in addition to the plating film, a falling out resistance property is improved. The same effect can be obtained even if the valve seat insert is a single layer of only the functional member side layer.

10 Claims, 5 Drawing Sheets

(56) References Cited

FOREIGN PATENT DOCUMENTS

| | | |
|---|---|---|
| JP | 52-153018 | 12/1977 |
| JP | 2000-240504 | 9/2000 |
| JP | 2004-522860 | 7/2004 |
| JP | 2007-162080 | 6/2007 |
| JP | 2008-231961 A | 10/2008 |
| JP | 2015-127520 | 7/2015 |
| JP | 2015-528053 | 9/2015 |
| WO | 2018/020979 | 2/2018 |

OTHER PUBLICATIONS

Office Action issued in Japanese Patent Application No. 2020-519649 dated Apr. 5, 2022.

Office Action issued in Chinese Patent Application No. 201980032224.1 dated Mar. 21, 2022.

* cited by examiner

IRON-BASED SINTERED ALLOY VALVE SEAT FOR INTERNAL COMBUSTION ENGINE

This application is the U.S. national phase of International Application No. PCT/JP2019/019080 filed May 14, 2019 which designated the U.S. and claims priority to JP Patent Application No. 2018-093627 filed May 15, 2018 and JP Patent Application No. 2019-017607 filed Feb. 4, 2019, the entire contents of each of which are hereby incorporated by reference.

TECHNICAL FIELD

The present invention relates to an iron-based sintered alloy valve seat insert for an internal combustion engine, and particularly relates to a valve seat insert having improved heat dissipation property while maintaining wear resistance.

BACKGROUND ART

In an internal combustion engine, a valve seat insert on which a valve is seated is required to maintain wear resistance so that it can sufficiently withstand wear due to repeating contact with the valve and excellent heat dissipation property as well as to be able to maintain airtightness of a combustion chamber. In particular, the heat dissipation property of the valve seat insert is a characteristic that greatly affects an engine output, and therefore, a valve seat insert that maintains an excellent heat dissipation property has been desired.

In recent years, a valve seat insert having a two-layer structure of different materials has been applied. In this valve seat insert having the two-layer structure, while a functional member side layer made of a material having excellent wear resistance is disposed on a valve-contacting face side on which the valve is seated, a supporting member side layer having excellent thermal conductivity is disposed on a seating face side in contact with a cylinder head, and these two layers are integrated. In recent years, most of valve seat inserts having such a two-layer structure are made of sintered alloys using a powder metallurgy method because of high dimensional accuracy of the powder metallurgy method and the ability to use special alloys.

With the recent promotion of higher efficiency and higher load of internal combustion engines, the temperature around combustion chambers tends to further increase. Thus, there is a concern about the occurrence of knocking. In order to suppress the occurrence of knocking and achieve higher efficiency of internal combustion engines, lowering the temperature of valves and valve seat inserts is considered to be an important point.

For such needs, for example, Patent Literature 1 describes a sintered valve seat insert for internal combustion engines that exhibits good machinability, wear resistance, and high heat transfer property. The technique described in Patent Literature 1 uses, as a material (mixture) for valve seat insert, a material containing a sinter-hardenable ferrous powder forming 75 to 90% by weight of the mixture, preferably 5 to 25% by weight of a tool steel powder, a solid lubricant, and Cu added by infiltration during sintering. In the technique described in Patent Literature 1, an iron powder to be used is preferably an iron powder containing 2 to 5% by weight Cr, 0 to 3% by weight Mo, and 0 to 2% by weight Ni. The solid lubricant is preferably 1 to 5% by weight of a solid lubricant selected from one or more of the group consisting of MnS, $CaF_2$, and $MoS_2$. Cu added by infiltration of a molding body during sintering is preferably 10 to 25% by weight of the molding body. Consequently, pores are filled with Cu alloy, so that thermal conductivity is significantly improved. According to the technique described in Patent Literature 1, a sintered valve seat insert for internal combustion engines that exhibits good machinability, wear resistance, and high heat transfer property can be obtained.

Patent Literature 2 describes an iron-based sintered alloy valve seat insert for an internal combustion engine, which has excellent thermal conductivity. The technique described in Patent Literature 2 is the iron-based sintered alloy valve seat insert for an internal combustion engine, which is formed by integrating two layers of a valve-contacting face side layer and a supporting member side layer. In this technology, the supporting member side layer is formed to be a layer having a thermal conductivity rate at 20 to 300° C. of 23 to 50 W/m·K, and the valve-contacting face side layer is formed to be a layer having a thermal conductivity rate at 20 to 300° C. of 10 to 22 W/m·K. The valve-contacting face side layer is made as thin as possible, the supporting member side layer is made thick, and a contact face to a cylinder head is made wide. Thus, a boundary between the valve-contacting face side layer and the supporting member side layer is formed in a region surrounded by a face that includes a circular line being 0.5 mm apart from the valve contacting face toward the supporting member side at a central position in a width direction of the valve contacting face and has an angle of 45° with respect to a valve seat insert axis and a face that includes a line of intersection of an inner peripheral surface of the valve seat insert and the seating face of the valve seat insert and a circular line having a distance of ½ of a valve seat insert height from the seating face of the valve seat insert on an outer peripheral surface of the valve seat insert. In order to stably form the boundary with the above-mentioned shape, it is important to adjust a balance between a molding face shape of a provisional pressing punch and a molding pressure during provisional pressing when a mixed powder for the supporting member side layer is provisionally pressed using the provisional pressing punch, and adjust the molding pressure of an upper punch when further integrally pressing a mixed powder for the supporting member side layer and a mixed powder for the valve-contacting face side layer. According to the technique described in Patent Literature 2, it is preferable that the valve-contacting face side layer is formed of an iron-based sintered alloy having a matrix part in which hard particles are dispersed in a matrix phase, in which the matrix part has a matrix part composition containing C: 0.2 to 2.0% by mass and one kind or two or more kinds selected from among Co, Mo, Si, Cr, Ni, Mn, W, V, S, Ca, and F in a total amount of 40% by mass or less with the balance being Fe and unavoidable impurities, and a base matrix phase structure in which hard particles are dispersed in a matrix phase in an amount of 5 to 40% by mass with respect to the total amount of the valve-contacting face side layer. On the other hand, it is preferable that the supporting member side layer is formed of an iron-based sintered alloy having a matrix part composition containing C: 0.2 to 2.0% by mass with the balance being Fe and unavoidable impurities. According to the technique described in Patent Literature 2, a thin valve seat insert having a stable boundary of two layers can be produced extremely easily as compared with conventional techniques. Furthermore, according to this technique, there can be formed a valve seat insert which is suitable for internal combustion engines and secures high thermal conductivity while maintaining excellent wear resistance.

Patent Literature 3 describes a highly thermally conductive valve seat insert ring. The technique described in Patent Literature 3 is a valve seat insert ring having a carrier layer and a functional layer and produced by a powder metallurgy method, which is characterized by having a thermal conductivity rate exceeding 55 W/m·K. According to the technique described in Patent Literature 3, a carrier material forming the carrier layer and/or a functional material forming the functional layer contains copper added by infiltration. The carrier material forming the carrier layer is formed of an iron-copper alloy and preferably contains more than 25% by weight and 40% by weight or less of copper. The functional material forming the functional layer preferably contains 8.0% by weight or more of copper. The carrier material forming the carrier layer further contains 0.5 to 1.8% by weight of C, 0.1 to 0.5% by weight of Mn, and 0.1 to 0.5% by weight of S, and contains Fe as the balance. In addition, the functional material forming the functional layer further contains 0.5 to 1.2% by weight of C, 6.0 to 12.0% by weight of Co, 1.0 to 3.5% by weight of Mo, 0.5 to 3.0% by weight of Ni, 1.5 to 5.0% by weight of Cr, 0.1 to 1.0% by weight of Mn and 0.1 to 1.0% by weight of S, and contains Fe as the balance.

Conventionally, in an insert-type valve seat insert made of a sintered material, it has been pointed out that a creep property peculiar to the sintered material causes a decrease in interference and a risk of falling off from a cylinder head is present. In particular, it has been known that these problems frequently occur in engines with a high thermal load represented by diesel engines.

To solve such a problem, for example, Patent Literature 4 describes an insert-type valve seat insert made of a sintered material, in which at least an outer peripheral surface is plated with copper or other metal having high thermal conductivity. According to the technique described in Patent Literature 4, it is possible to reduce a temperature rise of the valve seat insert to prevent deterioration of the material, and to suppress the decrease in interference peculiar to the sintered material.

Patent Literature 5 describes a cylinder head with a valve seat insert. The technique described in Patent Literature 5 is intended to increase bonding strength between the valve seat insert and the cylinder head, and is a cylinder head with a valve seat insert, which is formed by press-fitting a valve seat insert made of a sintered alloy mainly composed of iron into a valve port of the cylinder head made of an aluminum alloy and then bonding the valve seat insert by high-frequency heating. In the technique described in Patent Literature 5, it is preferable to perform a Cu-based plating treatment on the valve seat insert. Consequently, the sintered alloy can be sealed, the thermal conductivity can be improved, and the bonding strength to the cylinder head can be increased.

Patent Literature 6 describes automobile parts. The technique described in Patent Literature 6 is an automobile part including an automobile part and a composite plating film formed on at least a portion of a surface of the automobile part and containing nanocarbon and aluminum. A content of nanocarbon in the composite plating film is 1 to 40%, and an aspect ratio of nanocarbon is 20 or more. According to this technique, it is possible to manufacture automobile parts having excellent thermal conductivity. A valve seat insert is also exemplified as an example of the automobile member.

CITATION LIST

Patent Literature

Patent Literature 1: JP 2004-522860 T
Patent Literature 2: JP 2015-127520 A
Patent Literature 3: JP 2015-528053 T
Patent Literature 4: JP S52-153018 A
Patent Literature 5: JP 2000-240504 A
Patent Literature 6: JP 2007-162080 A

SUMMARY OF INVENTION

Technical Problem

According to the technique described in Patent Literature 1, a valve seat insert having excellent thermal conductivity can be obtained. However, in the technique described in Patent Literature 1, there is a problem that adhesion of Cu easily occurs because the amount of Cu added by infiltration is as large as 10% by weight or more, and, in addition, wear resistance deteriorates due to the adhesion of Cu because no adhesion prevention measures such as hard particles, are taken, so that it is impossible to stably produce valve seat inserts having both thermal conductivity and wear resistance.

In the technique described in Patent Literature 2, it is difficult to produce valve seat inserts having high thermal conductivity as recently required. In addition, this technique is problematic in that in order to achieve a configuration where the contact face with a cylinder head is enlarged by thinning the valve-contacting face side layer as much as possible and thickening the supporting member side layer as much as possible, it is necessary to adjust the boundary between the valve-contacting face side layer and the supporting member side layer by using a provisional pressing punch and a pressing facility having a complicated structure is required.

The technique described in Patent Literature 3 is problematic in that in the functional layer, the amount of Cu added by infiltration is as large as 8% by weight or more and condense of Cu easily occurs, but wear resistance easily deteriorates because no measures for preventing adhesion of Cu is taken, so that valve seat inserts having both thermal conductivity and wear resistance cannot be produced stably.

The technique described in Patent Literature 4 is directed to a valve seat insert press-fitted into a cast iron cylinder head in an engine having a thermal load represented by a diesel engine, and there is no mention of problem in recent aluminum alloy cylinder heads.

The technique described in Patent Literature 5 requires high-frequency heat treatment, which complicates the process and causes a problem that manufacturing cost rises.

In the technique described in Patent Literature 6, it is necessary to form a plating film by a special plating treatment, and there are problems that the process is complicated and it is difficult to form a uniform plating film.

The present invention solves the problems of the prior art, and an object thereof is to provide a valve seat insert for an internal combustion engine, which is used while being press-fitted into an aluminum alloy cylinder head, and further provide an iron-based sintered alloy valve seat insert for an internal combustion engine which does not require a complicated manufacturing process, is not accompanied by a significant decrease in wear resistance compared with the prior art, and has an excellent heat dissipation property.

The term "excellent heat dissipation property" as used herein refers to a case where a temperature of a valve abutted against the valve seat insert upon heating under predetermined conditions is lower compared to the valve temperature when a conventional valve seat is used by 20° C. or lower. The term "conventional valve seat insert" as used herein refers to an iron-based sintered alloy valve seat insert for an internal combustion engine formed by integrating two layers of a functional member side layer and a supporting member side layer, and further refers to an iron-based sintered alloy valve seat insert in which the functional member side layer has a structure in which hard particles are dispersed in a matrix phase, a matrix part composition including the matrix phase and the hard particles contains C: 0.2 to 2.0% by mass and one kind or two or more kinds selected from among Co, Mo, Si, Cr, Ni, Mn, W, V, Cu, and S in a total amount of 50% by mass or less with the balance being Fe and unavoidable impurities, and, on the other hand, the supporting member side layer has a matrix part composition containing C: 0.2 to 2.0% by mass or further containing one kind or two or more kinds selected from among Mo, Si, Cr, Ni, Mn, W, V, S, P, and Cu in a total amount of 20% by mass or less with the balance being Fe and unavoidable impurities.

Solution to Problem

The present inventors have conducted intensive investigations on various factors affecting a heat dissipation property of an iron-based sintered alloy valve seat insert in order to achieve the object described above. As a result, in an iron-based sintered alloy valve seat insert for an internal combustion engine, which is formed by integrating two layers of a functional member side layer and a supporting member side layer, it has been newly found that a temperature of a valve to be abutted is remarkably lowered by forming a plating film preferably having a hardness in a proper range and a proper film thickness on at least an outer peripheral surface of the valve seat insert.

In addition, the present inventors have arrived at the fact that the valve seat insert can be stably subjected to a plating treatment by preliminarily performing impregnation treatment (sealing hole treatment) of pores with a curable resin on a sintered body and sealing the entire pores.

The present invention has been made on the basis of the above-described findings and further investigations. The gist of the present invention is as follows.

(1) An iron-based sintered alloy valve seat insert for an internal combustion engine which is a valve seat insert for an internal combustion engine to be press-fitted into an aluminum alloy cylinder head, the valve seat insert made of an iron-based sintered alloy including a single layer of only a functional member side layer, or integrated two layers of the functional member side layer and a supporting member side layer, in which a plating film is provided on at least an outer peripheral side, and a heat dissipation property is excellent.

(2) The iron-based sintered alloy valve seat insert for an internal combustion engine according to (1), in which the plating film is a plating film having a thickness of 1 to 100 μm and a hardness of 50 to 300 HV in a Vickers hardness HV, and the hardness of the plating film satisfies a range of 1.05 to 4.5 times a hardness of the cylinder head in the Vickers hardness HV.

(3) The iron-based sintered alloy valve seat insert for an internal combustion engine according to (1) or (2), in which the functional member side layer or the two layers of the functional member side layer and the supporting member side layer is/are layers formed by being subjected to a sealing hole treatment.

(4) The iron-based sintered alloy valve seat insert for an internal combustion engine according to any one of (1) to (3), in which surface roughness of the plating film is 0.1 to 1.6 μm in arithmetic average roughness Ra in accordance with the provisions of JIS B 0601-1994.

(5) The iron-based sintered alloy valve seat insert for an internal combustion engine according to any one of (1) to (4), in which the plating film is a copper plating film or a tin plating film.

(6) The iron-based sintered alloy valve seat insert for an internal combustion engine according to any one of (1) to (5), in which a concave-convex mixed portion having, in a direction perpendicular to a circumferential direction, a plurality of rows of concave-convexes where concaves and convexes extending in the circumferential direction are adjacent to each other is provided as a roughened surface region at at least one portion on an outer peripheral surface of the valve seat insert, and the roughened surface region is provided at an area ratio of 0.3% or more in total with respect to an entire region of the outer peripheral surface.

(7) The iron-based sintered alloy valve seat insert for an internal combustion engine according to (6), in which when the concave-convex mixed portion is observed from a direction perpendicular to the outer peripheral surface, the concave-convex mixed portion has a triangular shape in a press-fitting direction, and an apex of the triangular shape facing the press-fitting direction has an apex angle of 10 to 150°.

(8) The iron-based sintered alloy valve seat insert for an internal combustion engine according to (1), in which when the two layers of the functional member side layer and the supporting member side layer are integrated, the functional member side layer is 10 to 70% by volume with respect to a total amount of the valve seat insert.

(9) The iron-based sintered alloy valve seat insert for an internal combustion engine according to (1), in which the functional member side layer has a matrix part in which hard particles are dispersed in a matrix phase, the matrix part has a matrix part composition containing C: 0.2 to 2.0% by mass and one kind or two or more kinds selected from among Co, Mo, Si, Cr, Ni, Mn, W, V, Cu, and S in a total amount of 50% by mass or less with the balance being Fe and unavoidable impurities, and a base matrix phase structure in which the hard particles are dispersed in the matrix phase in an amount of 5 to 40% by mass with respect to the total amount of the functional member side layer.

(10) The iron-based sintered alloy valve seat insert for an internal combustion engine according to (1), in which the supporting member side layer has a matrix part composition containing C: 0.2 to 2.0% by mass or further containing one kind or two or more kinds selected from among Mo, Si, Cr, Ni, Mn, W, V, S, P, and Cu in a total amount of 20% by mass or less with the balance being Fe and unavoidable impurities.

(11) The iron-based sintered alloy valve seat insert for an internal combustion engine according to (9), in which in addition to the base matrix phase structure, the functional member side layer further has a base matrix phase structure in which solid lubricant particles are dispersed in an amount of 0.5 to 4% by mass with respect to the total amount of the functional member side layer.

(12) The iron-based sintered alloy valve seat insert for an internal combustion engine according to (10), in which the supporting member side layer further has a structure in which solid lubricant particles are dispersed in the matrix phase in an amount of 0.5 to 4% by mass with respect to a total amount of the supporting member side layer.

Advantageous Effects of Invention

The present invention relates to a valve seat insert for an internal combustion engine, which is press-fitted into an aluminum alloy cylinder head and can provide an iron-based sintered alloy valve seat insert which does not go through complicated processes, is not accompanied by a significant decrease in wear resistance compared with the prior art, and has both excellent wear resistance and excellent heat dissipation property, and thus industrially a remarkable effect is exhibited.

DESCRIPTION OF EMBODIMENTS

A valve seat insert 10 of the present invention includes a functional member side layer 11 on a side where the valve seat insert 10 is to come into contact with a valve and a supporting member side layer 12 on a side where the valve seat insert 10 is to come into contact with a seating face of a cylinder head, and the valve seat insert 10 is an iron-based sintered alloy valve seat insert for an internal combustion engine, which is formed by integrating two layers of the functional member side layer 11 and the supporting member side layer 12. The valve seat insert 10 of the present invention may be a single layer of only the functional member side layer 11. The valve seat insert 10 of the present invention has a plating film 13 on at least an outer peripheral surface. In the valve seat insert 10 of the present invention, the type of the plating film 13 formed on at least the outer peripheral surface is not particularly limited, but Cu (copper), Sn (tin), Ni, Ag, Al, Au, Cr, Zn, and the like can be exemplified. Among them, Cu is preferably pure Cu, and Sn is preferably pure Sn.

Figure 1:
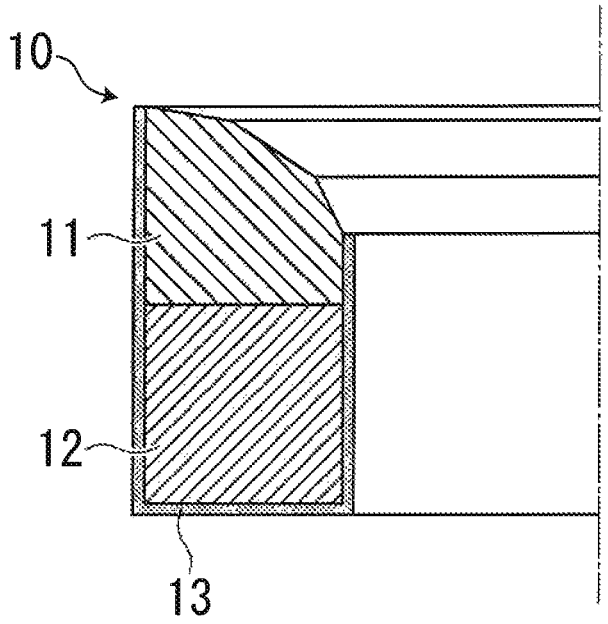
FIG. 1 is an explanatory view schematically showing an example of a cross section of a valve seat insert of the present invention.

FIG. 1 shows an example of the valve seat insert 10 of the present invention. FIG. 1 shows only a case where the two layers of the functional member side layer and the supporting member side layer are integrated. The illustration is omitted in a case of a single layer of only the functional member side layer. In FIG. 1, the plating film 13 is formed not only on the outer peripheral surface but also on the seating face and some parts of the inner peripheral surface. By increasing a formation region of the plating film, a heat dissipation property of the valve seat insert is improved.

In the valve seat insert 10 of the present invention, the plating film formed on at least the outer peripheral surface is preferably a plating film having a thickness of 1 to 100 μm and a hardness of 50 to 300 HV.

If the thickness of the plating film is less than 1 μm, the plating film is too thin to achieve a desired improvement in heat dissipation property of the valve seat insert. On the other hand, if the thickness of the plating film exceeds 100 μm, adhesion of the plating film deteriorates. Thus, the thickness of the plating film formed on at least the outer peripheral surface is preferably limited to the range of 1 to 100 μm. The thickness of the plating film is more preferably 1 to 50 μm, still more preferably 1 to 10 μm.

If the hardness of the plating film is less than 50 HV in Vickers hardness HV, the plating film is too soft, and problems such as peeling of the plating film occur when the valve seat insert is press-fitted into the cylinder head. On the other hand, when the hardness of the plating film exceeds 300 HV, the adhesion to the cylinder head is lowered, and the heat dissipation property is lowered. Thus, the hardness of the plating film formed on at least the outer peripheral surface is preferably limited to the hardness range of 50 to 300 HV. The hardness of the plating film is more preferably 50 to 200 HV, still more preferably 50 to 150 HV.

It is preferable that the plating film formed on at least the outer peripheral surface of the valve seat insert is adjusted so as to satisfy the above hardness range and a range of 1.05 to 4.5 times the hardness of the cylinder head into which the valve seat insert is press-fitted. If the hardness of the plating film is below the above range with respect to the hardness of the cylinder head, the plating film is likely to peel off. On the other hand, if the hardness of the plating film is above the above range, "galling of plating" occurs, and the valve seat insert cannot be press-fitted.

Surface roughness of the plating film is preferably limited to a range of 0.1 to 1.6 μm in arithmetic average roughness Ra in accordance with the provisions of JIS B 0601-1994. If the surface roughness Ra of the plating film is out of the above range, the adhesion to the cylinder head is lowered, and the heat dissipation property is also lowered. The surface roughness Ra is more preferably 0.1 to 0.5 μm.

By forming a plating film having the above characteristics on at least the outer peripheral surface of the valve seat insert, the heat dissipation property of the valve seat insert is improved. When the valve seat insert of the present invention as described above is press-fitted into an aluminum alloy cylinder head, the temperature of the valve abutted against a valve contacting face of the valve seat insert is significantly lowered.

The valve seat insert on which the plating film having the above characteristics is formed does not need to be limited, and both a commonly used valve seat insert having a single-layer structure of only the functional member side layer and a valve seat insert having a structure in which two layers of the functional member side layer and the supporting member side layer are integrated can be applied. However, in order to significantly improve the heat dissipation property of the valve seat insert without causing a significant decrease in wear resistance, the valve seat insert to be used preferably has the following composition and structure.

In the valve seat insert having a two-layer structure used in the present invention, it is preferable that at least the valve contacting face is formed on the functional member side layer, and a proportion of the functional member side layer is 10 to 70% by volume with respect to a total amount of the valve seat insert. If the proportion of the functional member side layer 11 is less than 10% by volume with respect to the total amount of the valve seat insert, the functional member side layer becomes too thin, and durability of the valve seat insert is lowered. On the other hand, if the proportion of the functional member side layer 11 increases so as to exceed 70% by volume with respect to the total amount of the valve seat insert, the functional member side layer becomes too thick, and the thermal conductivity decreases. The proportion of the functional member side layer 11 is more preferably 10 to 50% by volume with respect to the total amount of the valve seat insert.

The functional member side layer of the valve seat insert used in the present invention has a structure composed of a matrix phase, hard particles dispersed in the matrix phase, and pores. By dispersing the hard particles in the matrix phase, the wear resistance of the valve seat insert is improved. Solid lubricant particles may be further dispersed in the matrix phase.

An amount of the hard particles dispersed in the matrix phase of the functional member side layer of the valve seat insert of the present invention is preferably 5 to 40% by mass with respect to a total amount of the functional member side layer. If the amount of dispersed hard particles is less than 5% by mass, the above effects cannot be expected. On the other hand, if more than 40% by mass of the hard particles are dispersed, opposite aggressiveness increases. Thus, the amount of the hard particles is preferably limited to the range of 5 to 40% by mass. The amount of the hard particles is more preferably 10 to 30% by mass.

The hard particles dispersed in the matrix phase are preferably particles composed of one kind or two or more kinds of elements selected from among C, Cr, Mo, Co, Si, Ni, S, and Fe. The hard particles have the composition described above and are preferably particles having a hardness of 600 to 1200 HV in Vickers hardness. If the hardness of the hard particles is less than 600 HV, the wear resistance decreases. On the other hand, if the hardness exceeds 1200 HV, toughness decreases, and a risk of chipping and cracking increases.

As such hard particles, it is preferable to use Co-matrix intermetallic compound particles. Examples of the Co-based intermetallic compound particles include Cr—Mo—Co-type intermetallic compound particles and Ni—Cr—Mo—Co-type intermetallic compound particles.

The Cr—Mo—Co-type intermetallic compound particles are intermetallic compound particles containing Cr: 5.0 to 20.0% by mass and Mo: 10.0 to 30.0% by mass with the balance being Co and unavoidable impurities. The Ni—Cr—Mo—Co-type intermetallic compound particles are intermetallic compound particles containing Ni: 5.0 to 20.0% by mass, Cr: 15.0 to 30.0% by mass and Mo: 17.0 to 35.0% by mass with the balance being Co and unavoidable impurities.

Fe—Mo alloy particles, Fe—Ni—Mo—S-type alloy particles, Fe—Mo—Si-type alloy particles, and the like other than the above particles are also suitable.

The Fe—Mo alloy particles are alloy particles containing Mo: 50.0 to 70.0% by mass with the balance being Fe and unavoidable impurities. The Fe—Ni—Mo—S-type alloy particles are alloy particles containing Ni: 50.0 to 70.0% by mass, Mo: 20.0 to 40.0% by mass, and S: 1.0 to 5.0% by mass with the balance being Fe and unavoidable impurities. The Fe—Mo—Si-type particles are alloy particles containing Si: 5.0 to 20.0% by mass and Mo: 20.0 to 40.0% by mass with the balance being Fe and unavoidable impurities.

In addition to the hard particles described above, solid lubricant particles may be further dispersed in the matrix phase of the functional member side layer of the valve seat insert of the present invention. The solid lubricant particles have the effect of improving machinability and wear resistance and reducing opposite aggressiveness. The solid lubricant particles are preferably one kind or two or more kinds of elements selected from among sulfides such as MnS and $MoS_2$ and fluorides such as $CaF_2$, or a mixture thereof. The solid lubricant particles are preferably dispersed in a total of 0.5 to 4% by mass with respect to the total amount of the functional member side layer. If the amount of the solid lubricant particles is less than 0.5% by mass, the amount of solid lubricant particles is small, and the machinability is lowered. In addition, the occurrence of adhesion is promoted, and the wear resistance decreases. On the other hand, if more than 4% by mass of the solid lubricant particles is dispersed, the effect is saturated, and the effect to meet the content cannot be expected. Thus, it is preferable to limit the content of the solid lubricant particles to 0.5 to 4% by mass in total.

The matrix phase of the functional member side layer of the valve seat insert of the present invention preferably has a structure composed of pearlite occupying 30 to 60% of the area of the matrix phase and high-alloy diffusion phase occupying 40 to 70% of the area when the area of the matrix phase except for the hard particles is normalized to 100%.

In the functional member side layer of the valve seat insert of the present invention, it is preferable that the matrix part including the matrix phase and the hard particles, or further including the solid lubricant particles has a matrix part composition containing C: 0.2 to 2.0% by mass and one kind or two or more kinds selected from among Co, Mo, Si, Cr, Ni, Mn, W, V, Cu, and S in a total amount of 50% by mass or less with the balance being Fe and unavoidable impurities.

C: 0.2 to 2.0%

C is an element that increases the strength and hardness of sintered bodies and facilitates diffusion of metal elements during sintering. In order to acquire such an effect, it is preferable to contain C in the amount of 0.2% or more. On the other hand, when the content exceeds 2.0%, cementite is easily generated in the matrix, and a liquid phase is easily generated during sintering, so that dimensional accuracy is lowered. Thus, it is preferable to limit C in the range of 0.2 to 2.0%. The amount of C is more preferably 0.7 to 1.3%.

One kind or two or more kinds selected from among Co, Mo, Si, Cr, Ni, Mn, W, V, Cu, and S: 50% or less in total All of Co, Mo, Si, Cr, Ni, Mn, W, V, Cu, and S are elements that increase the strength and hardness of sintered bodies and further contribute to improvement in the wear resistance. It is desirable to select at least one kind among them to be contained in a total amount of 5% or more including the element originating in the hard particles in order to obtain such an effect. On the other hand, the compactibility and the strength decrease when the content of these elements exceeds 50% in total. Thus, it is preferable that the content of one kind or two or more kinds selected from among Co, Mo, Si, Cr, Ni, Mn, W, V, Cu, and S is limited to 50% or less in total. The content is more preferably 25% or more. The balance other than the above components contains Fe and unavoidable impurities. In the matrix phase of the functional member side layer, the solid lubricant particles may be dispersed in an amount of 0.5 to 4% by mass with respect to the total amount of the functional member side layer.

The functional member side layer of the valve seat insert of the present invention may have the following composition instead of the above composition. In the functional member side layer of the valve seat insert of the present invention, the matrix part including the matrix phase and the hard particles may have a composition containing one kind or two or more kinds selected from among Ni: 0.1 to 23.0% by mass, Cr: 0.4 to 15.0% by mass, Mo: 0.1 to 15.0% by mass, Cu: 0.2 to 5.0% by mass, Co: 3.0 to 25.0% by mass, V: 0.1 to 2.0% by mass, Mn: 0.1 to 2.0% by mass, W: 0.2 to 6.0% by mass, C: 0.2 to 2.0% by mass, Si: 0.1 to 2.0% by mass, and S: 0.1 to 1.5% by mass in a total amount of 3.0 to 50.0% by mass with the balance being Fe and unavoidable impurities.

All of Ni, Cr, Mo, Cu, Co, V, Mn, W, C, Si, and S are elements that are contained in the matrix phase and the hard particles of the functional member side layer and improve the wear resistance, and one kind or two or more kinds selected from among these elements can be contained in a total amount of 3.0 to 50.0% by mass. Hereinafter, the mass % relating to the composition is simply expressed as %.

Ni: 0.1 to 23.0%

Ni is an element that contributes to improvement in the strength and toughness of the matrix phase and also contributes to an increase in the hardness of the hard particles, and improves the hardness and heat-resistance property in addition to improvement in the wear resistance. If the content is less than 0.1%, the above effects are not observed. On the other hand, the opposite aggressiveness increases when the content exceeds 23.0%. Thus, when Ni is contained, it is preferable to limit the content of Ni in the range of 0.1 to 23.0%.

Cr: 0.4 to 15.0%

Cr is an element that is contained in the matrix phase and the hard particles, also forms carbides, and improves the hardness and the heat-resistance property in addition to improvement in the wear resistance. However, if the content is less than 0.4%, the above effects are not observed. On the other hand, the opposite aggressiveness increases when the content exceeds 15.0%. Thus, when Cr is contained, it is preferable to limit the content of Cr in the range of 0.4 to 15.0%.

Mo: 0.1 to 15.0%

Mo is an element that is contained in the matrix phase and the hard particles, increases the hardness of the matrix phase and the hard particles, and improves the hardness and the heat-resistance property in addition to improvement in the wear resistance. However, if the content is less than 0.1%, the above effects are not observed. On the other hand, the opposite aggressiveness increases when the content exceeds 15.0%. Thus, when Mo is contained, it is preferable to limit the content of Mo in the range of 0.1 to 15.0%.

Cu: 0.2 to 5.0%

Cu is an element that contributes improvement in the strength and toughness of the matrix phase and improves the wear resistance. However, if the content is less than 0.2%, the above effects are not observed. On the other hand, when the content exceeds 5.0%, free Cu is precipitated, and the valve seat insert is caused to adhere to the valve in operation. Thus, when Cu is contained, it is preferable to limit the content of Cu in the range of 0.2 to 5.0%.

Co: 3.0 to 25.0%

Co is an element that increases the strength of the matrix phase, especially high temperature strength, contributes to improvement in the wear resistance, further improves the toughness of the matrix phase, has the effect of strengthening bond between the hard particles and the matrix phase, and further has the effect of improving heat-resistance property. However, if the content is less than 3.0%, the above effects are not observed. On the other hand, when the content exceeds 25.0%, the hardness of the matrix phase is lowered, so that desired characteristics cannot be secured. Thus, when Co is contained, it is preferable to limit the content of Co in the range of 3.0 to 25.0%.

V: 0.1 to 2.0%

V is an element that precipitates as a carbide, strengthens the matrix phase, and improves the wear resistance. However, if the content is less than 0.1%, the above effects are not observed. On the other hand, when the content exceeds 2.0%, the opposite aggressiveness increases, and the moldability decreases. Thus, when V is contained, it is preferable to limit the content of V in the range of 0.1 to 2.0%.

Mn: 0.1 to 2.0%

Mn is an element that increases the hardness of the matrix phase and improves the wear resistance. However, if the content is less than 0.1%, the above effects are not observed. On the other hand, the opposite aggressiveness increases when the content exceeds 2.0%. Thus, when Mn is contained, it is preferable to limit the content of Mn in the range of 0.1 to 2.0%.

W: 0.2 to 6.0%

W is an element that precipitates as fine carbides, increases the hardness of the matrix phase, and improves the wear resistance. However, if the content is less than 0.2%, the above effects are not observed. On the other hand, the opposite aggressiveness increases when the content exceeds 6.0%. Thus, when W is contained, it is preferable to limit the content of W in the range of 0.2 to 6.0%.

C: 0.2 to 2.0%

C is an element that adjusts the matrix phase to have a desired hardness and a desired structure, strengthens the matrix phase to contribute to improvement in the wear resistance, and further contributes to improvement in sintering diffusibility. However, if the content is less than 0.2%, the above effects are not observed. On the other hand, when the content exceeds 2.0%, the melting point is lowered to cause liquid phase sintering, and the dimensional accuracy is lowered. Thus, when C is contained, it is preferable to limit the content of C in the range of 0.2 to 2.0%.

Si: 0.1 to 2.0%

Si is an element that is mainly contained in the hard particles and increases hardness. However, if the content is less than 0.1%, the above effects are not observed. On the other hand, the toughness decreases when the content exceeds 2.0%. Thus, when Si is contained, it is preferable to limit the content of Si in the range of 0.1 to 2.0%.

S: 0.1 to 1.5%

S is an element that is contained in the matrix part due to the inclusion of the solid lubricant particles and contributes to improvement in the machinability. If the content is less than 0.1%, the above effects are not observed. On the other hand, when the content exceeds 1.5%, it leads to a decrease in toughness and ductility. Thus, when S is contained, it is preferable to limit the content of S in the range of 0.1 to 1.5%.

In the functional member side layer of the valve seat insert of the present invention, when the total content of the above components is less than 3.0%, the hardness of the matrix phase and high temperature characteristics such as the high temperature strength and creep strength are lowered. On the other hand, the opposite aggressiveness increases when the total content exceeds 50.0%. Thus, in the functional member side layer of the valve seat insert of the present invention, it is preferable to limit the total content of the above components to the range of 3.0 to 50.0%. The total content is more preferably 3.0 to 45.0%.

In the matrix phase of the functional member side layer of the valve seat insert of the present invention, the balance other than the above components is made up of Fe and unavoidable impurities.

On the other hand, the supporting member side layer of the valve seat insert of the present invention has a structure composed of the matrix phase and the pores. The solid lubricant particles may be dispersed in the matrix phase.

The matrix phase of the supporting member side layer of the valve seat insert of the present invention preferably has a structure composed of a pearlite single phase.

The supporting member side layer in the valve seat insert of the present invention preferably has a matrix part composition containing C: 0.2 to 2.0% by mass or further containing one kind or two or more kinds selected from among Mo, Si, Cr, Ni, Mn, W, V, S, P, and Cu in a total amount of 20% by mass or less with the balance being Fe and unavoidable impurities.

C: 0.2 to 2.0%

C is an element that increases the strength and hardness of sintered bodies, and it is desirable to contain 0.2% or more of C in order to secure desired strength and hardness as the valve seat insert. On the other hand, when the content exceeds 2.0%, cementite is easily generated in the matrix, and a liquid phase is easily generated during sintering, so that dimensional accuracy is lowered. Thus, it is preferable to limit C in the range of 0.2 to 2.0%. The amount of C is more preferably 0.7 to 1.3%.

One kind or two or more kinds selected from among Mo, Si, Cr, Ni, Mn, W, V, S, P, and Cu: 20% or less in total All of Mo, Si, Cr, Ni, Mn, W, V, S, P, and Cu are elements that increase the strength and hardness of sintered bodies, including the element originating in the solid lubricant particles or hard particles, and one kind or two or more kinds can be contained as needed. In order to obtain such an effect, it is desirable to contain a total amount of 5% or more. However, it is preferable that the content amount is contained as low as possible from the viewpoint of the heat dissipation property. On the other hand, the moldability decreases when the content of these elements exceeds 20% in total. Thus, it is preferable that the content of one kind or two or more kinds selected from among Mo, Si, Cr, Ni, Mn, W, V, S, P, and Cu is limited to 20% or less in total. The content is more preferably 5 to 15%.

In the supporting member side layer, the balance other than the above components contains Fe and unavoidable impurities.

In the matrix phase of the supporting member side layer, the solid lubricant particles may be dispersed in an amount of 0.5 to 4% by mass with respect to the total amount of the supporting member side layer. The solid lubricant particles have the effect of improving the machinability.

The supporting member side layer of the valve seat insert of the present invention may have the following composition instead of the above composition.

In the supporting member side layer of the valve seat insert of the present invention, the matrix phase preferably has a composition containing one kind or two or more kinds selected from among C, Ni, Cr, Mo, Cu, Co, V, and Mn in a total amount of 0.3 to 15% by mass with the balance being Fe and unavoidable impurities.

All of C, Ni, Cr, Mo, Cu, Co, V, and Mn are elements that improve the strength of the supporting member side layer and can contain one kind or two or more kinds selected from among these elements in a total amount of 0.3 to 15%. If the total content of these alloying elements is less than 0.3%, desired strength cannot be secured as the supporting member side layer. On the other hand, even if the total content exceeds 15%, the effect is saturated, and the effect to meet the content cannot be obtained, which is economically disadvantageous. Thus, it is preferable to limit the total content of the above components to the range of 0.3 to 15%.

In the matrix phase of the supporting member side layer of the valve seat insert of the present invention, the balance other than the above components is made up of Fe and unavoidable impurities.

The solid lubricant particles may be further dispersed in the matrix phase of the supporting member side layer of the valve seat insert of the present invention. The solid lubricant particles have the effect of improving the machinability. The solid lubricant particles are preferably one kind or two or more kinds of elements selected from among sulfides such as MnS and $MoS_2$ and fluorides such as $CaF_2$, or a mixture thereof. The solid lubricant particles are preferably dispersed in a total of 0.5 to 4% by mass with respect to the total amount of the supporting member side layer. If the amount of the solid lubricant particles is less than 0.5% by mass, the amount of solid lubricant particles is small, and the machinability is lowered. On the other hand, if more than 4% by mass of the solid lubricant particles is dispersed, the effect is saturated, and the effect to meet the content cannot be expected. Thus, it is preferable to limit the content of the solid lubricant particles to 0.5 to 4% by mass.

In the functional member side layer and the supporting member side layer of the valve seat insert of the present invention, it is preferable to seal the entire included pores. In the present invention, it is preferable to perform the sealing hole treatment on the pores before a plating treatment. The sealing hole treatment is preferably a commonly used treatment of vacuum impregnating the pores with a heat curing type resin or anaerobic resin.

Next, a preferable method of manufacturing the valve seat insert of the present invention will be described. First, a case of a two-layer structure of a functional member side layer and a supporting member side layer will be described.

In the present invention, first, a filling space (mold) in which a supporting member side layer (valve seat insert) having a predetermined shape can be formed is formed in a press molding machine, and the filling space is filled with a raw material powder (mixed powder) for the supporting member side layer. Then, a filling space (mold) in which a functional member side layer (valve seat insert) having a predetermined shape can be formed as an upper layer of the supporting member side layer is further formed, and the filling space is filled with a raw material powder (mixed powder) for the functional member side layer is filled. Then, the supporting member side layer and the functional member side layer are integrally pressure-molded to form a green compact (valve seat insert). From the viewpoint of strength of the green compact, it is preferable to perform pressure molding by adjusting a density of the green compact to be obtained is 6.5 to 7.5 $g/cm^3$.

The press molding machine used in the present invention is not particularly limited, and any press molding machine capable of molding a valve seat insert having a two-layer structure can be applied.

As the raw material powder (mixed powder) for the supporting member side layer, an iron-based powder and a powder for alloy such as a graphite powder and an alloy element powder are blended in prescribed amounts to result in the above-mentioned supporting member side layer composition, mixed, and kneaded to obtain a mixed powder (for the supporting member side layer). A solid lubricant particle powder may be further blended to the mixed powder in an amount of 0.5 to 4% by mass with respect to the total amount of the raw material powder for the supporting member side layer. The iron-based powder to be blended to the mixed powder may be a pure iron powder, an alloy iron powder, a steel-based powder with a specific composition, or a mixture thereof.

In addition, as the raw material powder (mixed powder) of the functional member side layer, an iron-based powder, a powder for alloy such as a graphite powder and an alloy element powder, and a hard particle powder are blended in prescribed amounts to result in the matrix part composition of the above-mentioned functional member side layer, mixed, and kneaded to obtain a mixed powder (for the functional member side layer). A solid lubricant particle powder may be further blended to the mixed powder in an amount of 0.5 to 4% by mass with respect to the total amount of the raw material powder for the functional member side layer. The iron-based powder to be blended to the mixed powder and thus to form the matrix phase may be a pure iron powder, an alloy iron powder, a steel-based powder with a specific composition, or a mixture thereof.

In the case of a single layer of only the functional member side layer, the same may be applied except that the supporting member side layer described above is not used.

Subsequently, the obtained green compact is subjected to sintering treatment to form a sintered body, which is then subjected to processing such as cutting to form a valve seat insert (a product) for internal combustion engines. The sintering temperature is preferably adjusted to 1000 to 1300° C. In order to impart a desired hardness, in addition to the sintering treatment, heat treatment (quenching and tempering treatment) may be performed.

In the present invention, it is preferable that the valve seat insert (product) obtained through the above steps is sealed. Needless to say, sufficient washing should be performed before the sealing hole treatment. For the sealing hole treatment, preferably, the valve seat insert is immersed in a liquid of a heat curing type resin or an anaerobic resin in a vacuum atmosphere. Then, in an atmospheric pressure atmosphere, the pores are sufficiently impregnated with the resin and then heated, and the resin in the pores is cured to seal the pores. Needless to say, when heating, the liquid (resin) on a surface of the valve seat insert is removed by draining, washing with water, or other means.

In the present invention, the valve seat insert subjected to the above-mentioned treatment is further subjected to a plating treatment to form the above-mentioned various plating films on at least the outer peripheral surface. As the plating treatment, any of commonly used plating treatments such as electroplating treatment and electroless plating treatment can be applied, and the plating treatment does not need to be particularly limited; however, electroplating treatment is preferably used from the viewpoint of plating adhesion.

From the viewpoint of improving the adhesion to the cylinder head, it is preferable that the plating treatment be applied so that the surface roughness of the plating film after the plating treatment is 0.1 to 1.6 μm in the arithmetic average roughness Ra in accordance with the provisions of JIS B 0601-1994.

The copper plating film is preferably formed by electroplating treatment. Examples of the electroplating treatment include a commonly used electroplating treatment using a copper sulfate bath, a copper cyanide bath, or the like. However, from the viewpoint of the adhesion of the plating film and uniformity of a plating film thickness, a plating treatment using a copper cyanide bath is preferable. An electroplating treatment for forming a tin plating film is preferably an electroplating treatment using a stannic salt bath, a sulfate bath, or the like. The plating film thickness is preferably adjusted by adjusting a current value, an electrolysis time, etc. in the usual manner.

For valve seat inserts to be subjected to the plating treatment, it is preferable that before the plating treatment, the surface roughness of the valve seat insert is set to about 0.2 to 0.3 μm in the arithmetic average roughness Ra in accordance with the provisions of JIS B 0601-1994 in order to improve the adhesion of the plating film.

The valve seat insert of the present invention is press-fitted into a predetermined portion of the cylinder head to form a structure for an internal combustion engine. That is, the structure for an internal combustion engine includes the cylinder head and the valve seat insert press-fitted into the predetermined portion of the cylinder head.

The cylinder head is made of aluminum alloy. As the aluminum alloy used for the cylinder head, for example, AC4B, AC2B, AC4D, AC5A, etc. according to the provisions of JIS H 5202 are suitable. These alloys usually show a hardness of about 60 to 90 HV in a state of being molded into the cylinder head.

As described above, the valve seat insert to be press-fitted into the cylinder head is the iron-based sintered alloy valve seat insert in which two layers of the functional member side layer and the supporting member side layer are integrated and which has the plating film on at least the outer peripheral surface. The hardness of the plating film formed on at least the outer peripheral surface is adjusted in the range of 50 to 300 HV so as to fall within a range of 1.05 to 4.5 times the hardness of the cylinder head, that is, the hardness of the aluminum alloy constituting the cylinder head. Consequently, it becomes possible to secure desired characteristics such as an excellent heat dissipation property in the valve seat insert after press-fitting into the cylinder head.

In the valve seat insert of the present invention, in addition to the formation of the plating film described above, it is preferable to further form a "roughened surface region" at at least one portion on the outer peripheral surface of the valve seat insert. The "roughened surface region" may be formed either before or after the above-mentioned plating film formation. The "roughened surface region" here means a region having a locally rough surface texture as compared with the surface roughness (Ra: about 0.8 μm) of a normal finished surface. When the valve seat insert is press-fitted into a light metal alloy cylinder head, this "roughened surface region" has an action to bite into a surface layer of the light metal alloy cylinder head to increase a bonding force (valve seat insert holding force) with the cylinder head, contribute to an increase in falling-off load, and suppress falling-off of the valve seat insert during engine operation. The formation of this roughened surface region is described in detail in PCT/JP2017/024854 by the present inventors. Any of the contents described in the above-mentioned document can be suitably applied to the present invention.

The "roughened surface region" formed on the outer peripheral surface of the valve seat insert of the present invention is preferably a convex portion having a constant peak height of 5 to 80 μm and/or a concave portion having a constant valley depth of 5 to 100 μm with respect to the outer peripheral surface. By forming the "roughened surface region" having such a surface texture at at least one portion on the outer peripheral surface at an area ratio of 0.3% or more with respect to an entire region of the outer peripheral surface, a desired holding force can be sufficiently maintained.

It is preferable that the shape of the "roughened surface region" which is the convex portion or the concave portion is a region shape that is long in a direction orthogonal to the press-fitting direction from the viewpoint of improving falling out resistance property. For example, the roughened surface region preferably has an inverted triangular shape or a quadrangular shape in the press-fitting direction when observed from a direction perpendicular to the outer peripheral surface. However, there is no problem if the roughened surface region has a triangular shape, a circular shape, a semicircular shape, or a star shape.

The convex portion may be a region having an inclined peak height where the peak height is based on the outer peripheral surface and continuously or gradually increases from the reference to a maximum peak height along the press-fitting direction. The concave portion may be a region having an inclined valley depth where the valley depth is based on the outer peripheral surface and continuously or gradually decreases from a maximum valley depth to the reference along the press-fitting direction.

Figure 5:
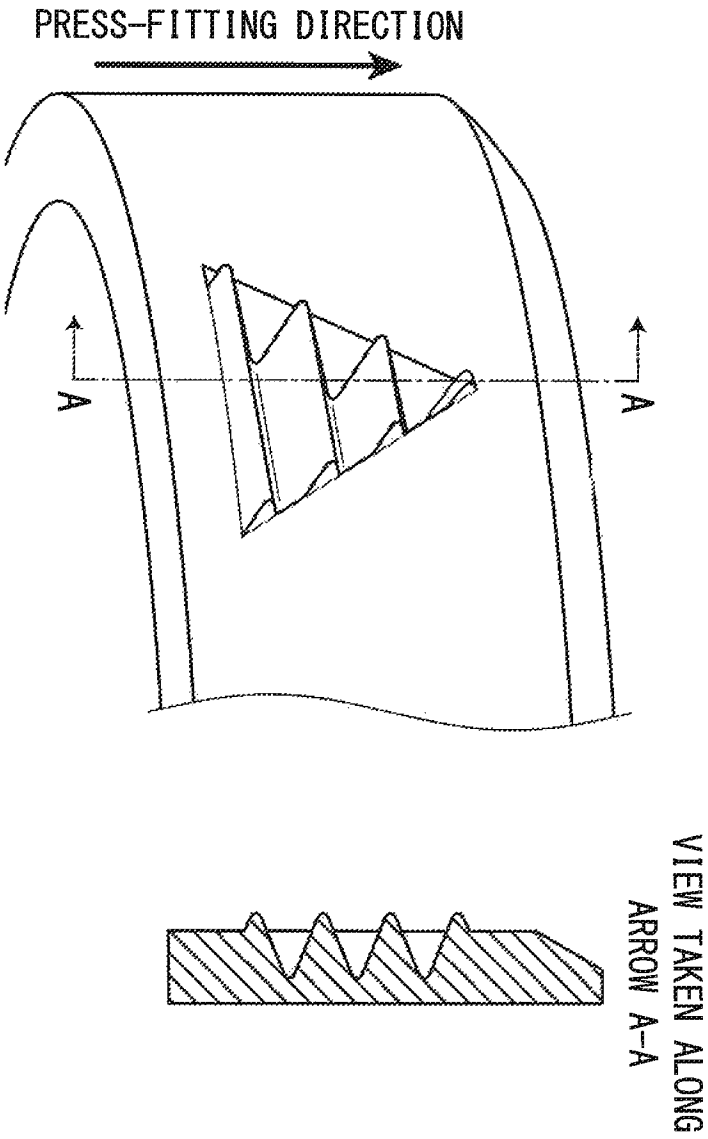
FIG. 5 is an explanatory diagram schematically showing a shape of a roughened surface region used in Examples.

The roughened surface region may be a region having, in a direction perpendicular to a circumferential direction, a plurality of rows of concave-convexes where concaves and convexes extending in the circumferential direction are adjacent to each other. An example of such a roughened surface region is shown in FIG. 5. Alternatively, the roughened surface region may be a region having, in a direction perpendicular to the press-fitting direction, a plurality of rows of concave-convexes where concaves and convexes extending in the press-fitting direction are adjacent to each other. These regions are referred to as "concave-convex mixed portions".

It is preferable to form the "roughened surface region" having such a surface texture at at least one portion on the outer peripheral surface at an area ratio of 0.3% or more with respect to the entire region of the outer peripheral surface.

The above-mentioned "concave-convex mixed portion" is preferably concave-convexes including convexes having a peak height of 3 to 80 μm and concaves having a valley depth of 3 to 100 μm with respect to the outer peripheral surface. In addition, the "concave-convex mixed portion" is preferably concave-convexes with a pitch (mountain pitch) of 1 to 600 μm that is an interval between two adjacent convexes in a cross-section perpendicular to a direction in which the concaves and the convexes extend.

The above-mentioned "concave-convex mixed portion" is more preferably a "concave-convex mixed portion" in which, when this concave-convex mixed portion is observed from a direction perpendicular to the outer peripheral surface, a triangular shape is provided in the press-fitting direction, and an apex of the triangular shape facing the press-fitting direction has an apex angle of 10 to 150°. Consequently, a pull-out load significantly increases.

By providing such a region on the outer peripheral surface of the valve seat insert, the falling out resistance property is remarkably improved as compared with a case where the concave or the convex is disposed alone.

The above-mentioned "roughened surface region" is preferably formed by laser light irradiation treatment. It is preferable that the laser light irradiation is performed by properly selecting and adjusting an irradiation pattern, an irradiation time, an output, a frequency, and the like so as to obtain the above-mentioned desired surface texture having a preset shape and size at a predetermined position on the outer peripheral surface of the valve seat insert previously set.

When the finished outer peripheral surface of the valve seat insert is irradiated with laser light, the surface melts, and the molten metal is discharged to form a concave. On the other hand, the discharged molten metal solidifies to form a convex therearound. The "roughened surface region" may be formed either before or after the above-mentioned plating film formation.

The present invention is further described below with reference to Examples.

EXAMPLES

Example 1

As raw-material powders, the raw-material powders (an iron-based powder, a graphite powder, a powder for alloying elements, a hard particle powder, a solid lubricant particle powder) shown in Table 1 were blended in the blend amounts shown in Table 1, mixed and kneaded to afford mixed powders A and B for functional member side layers. Further, the raw-material powders (an iron-based powder, a graphite powder, a powder for alloying elements, a hard particle powder, and a solid lubricant particle powder) shown in Table 2 were blended in the blend amounts shown in Table 2, mixed and kneaded to afford a mixed powder 1A for supporting member side layer. The compositions of various iron-based powders used are shown in Table 3, and the compositions of various hard particle powders used are shown in Table 4.

TABLE 1

| | For functional member side layer | | | | |
|---|---|---|---|---|---|
| Mixed powder No. | Iron-based powder Type*: blend amount (mass %) | Graphite powder Blend amount (mass %) | Alloy element powder Blend amount (mass %) | Hard particle powder Type**: blend amount (mass %) | Solid lubricant particle powder Type***: blend amount (mass %) |
| A | a: 62.8, b: 10 | 1.1 | Ni: 1.6, Co: 2.5 | HP1: 20 | SL1: 2 |
| B | a: 57.9, b: 10 | 1.0 | Ni: 1.6, Co: 2.5 | HP2: 25 | SL1: 2 |

*See Table 3

**See Table 4

***SL1: MnS

TABLE 2

| Mixed powder No. | For supporting member side layer: Iron-based powder Type*: blend amount (mass %) | Graphite powder Blend amount (mass %) | Alloy element powder Blend amount (mass %) | Hard particle powder Type**: blend amount (mass %) | Solid lubricant particle powder Type***: blend amount (mass %) |
|---|---|---|---|---|---|
| 1A | c: 94.75 | 0.92 | Ni: 0.33, Cu: 2.71 | HP3: 0.79 | SL1: 0.5 |

*See Table 3
**See Table 4
***SL1: MnS

TABLE 3

| Iron-based powder No. | Chemical composition (mass %): C | Si | Mn | Cr | Mo | V | W | Others | Balance | Remarks |
|---|---|---|---|---|---|---|---|---|---|---|
| a | 0.02 | — | — | — | — | — | — | 1% or less | Fe | Atomized powder |
| b | 0.90 | 0.30 | 0.20 | 4.10 | 4.90 | 2.00 | 5.80 | 1% or less | Fe | High-speed tool steel powder 1 |
| c | 0.02 | — | — | — | — | — | — | 1% or less | Fe | Reduced powder |

TABLE 4

| Hard particle No. | Chemical composition (mass %): Mo | Si | Ni | Cr | Co | Fe | Others | Hardness: Hv | Remarks |
|---|---|---|---|---|---|---|---|---|---|
| HP1 | 24 | 2 | 10 | 24 | Bal. | — | 3% or less | 1050 | Mo—Ni—Cr-type Co-based intermetallic compound powder |
| HP2 | 28 | 2.6 | — | 9 | Bal. | — | 3% or less | 750 | Cr—Mo-type Co-based intermetallic compound powder |
| HP3 | 60 | — | — | — | — | Bal. | 5% or less | 1100 | Fe—Mo-type hard particle powder |

Next, these mixed powders were integrally pressure molded (face pressure: 5.0 to 10.0 ton/cm$^2$) with a press molding machine, and thus a two-layered green compact for valve seat insert was obtained. The mixed powder for the functional member side layer was pressure molded in the same manner with the press molding machine, and thus a single-layered green compact for valve seat insert was obtained.

The obtained green compacts were further subjected to a 1P1S step of sintering treatment (heating temperature: 1000 to 1300° C.) to afford sintered bodies.

Subsequently, the obtained sintered bodies were cut and ground to afford a valve seat insert with an outer diameter of 27.1 mmφ, an inner diameter of 22.0 mmφ, and a thickness of 6.5 mm. A target surface roughness of the valve seat insert was 0.2 μm in Ra.

For each of the layers of the valve seat inserts obtained, the contents of the respective compositions were analyzed by emission analysis, and thus the composition of each layer was measured. The obtained results are shown in Table 5. Further, the cross section of the obtained valve seat insert was polished and subjected to nital etching, and the structure was observed and imaged using an optical microscope (magnification: 200 times). Image analysis was used to measure structural fractions of the matrix phase, hard particles, and solid lubricant particles in each layer. The obtained results are shown in Table 6.

TABLE 5

| Sintered body No. | Mixed powder No.: Functional member side layer | Supporting member side layer | Sintered body chemical composition (mass %): Functional member side layer: C | Others: Co | Ni | Mo | Cr | Mn | S | W | V | Others | Total | Balance | Supporting member side layer: C | Others: Mo, Si, Cr, Ni, Mn, W, V, S, Cu | Total | Balance |
|---|---|---|---|---|---|---|---|---|---|---|---|---|---|---|---|---|---|---|
| 1 | A | 1A | 1.1 | 10.5 | 3.5 | 5.3 | 5.5 | 1.2 | 0.8 | 0.6 | 0.2 | 1.2 | 28.8 | Fe | 1.2 | Mo: 0.6, Cu: 4.3, | 5.7 | Fe |

TABLE 5-continued

| Sintered body No. | Mixed powder No. Functional member side layer | Mixed powder No. Supporting member side layer | Sintered body chemical composition (mass %) Functional member side layer C | Co | Ni | Mo | Cr | Mn | S | W | V | Others | Total | Balance | Supporting member side layer C | Others V, S, Cu | Others Total | Others Balance |
|---|---|---|---|---|---|---|---|---|---|---|---|---|---|---|---|---|---|---|
| | | | | | | | | | | | | | | | | Mn: 0.3, S: 0.2, Ni: 0.3 | | |
| 2 | A | — | 1.1 | 10.4 | 3.5 | 5.6 | 5.3 | 1.2 | 0.8 | 0.6 | 0.2 | 1.3 | 28.9 | Fe | — | — | — | — |
| 3 | B | 1A | 1.0 | 17.3 | 1.8 | 7.4 | 2.3 | 1.0 | 0.7 | 0.6 | 0.2 | 1.2 | 32.6 | Fe | 1.2 | Mo: 0.6, Cu: 4.1, Mn: 0.3, S: 0.2, Ni: 0.2 | 5.4 | Fe |

TABLE 6

| Sintered body No. | Mixed powder No. Functional member side layer | Mixed powder No. Supporting member side layer | Sintered body structure (volume %) Functional member side layer: Matrix phase (volume %) Fine carbide precipitation phase | Pearlite phase | Others | Total | Hard particles (volume %) | Solid lubricant particle (volume %) | Supporting member side layer: Matrix phase (volume %) Pearlite phase | Others | Total | Solid lubricant particle (volume %) |
|---|---|---|---|---|---|---|---|---|---|---|---|---|
| 1 | A | 1A | 9.7 | 56.0 | 2.8 | 68.5 | 16.7 | 2.2 | 75.2 | 2.5 | 77.7 | 0.3 |
| 2 | A | — | 9.5 | 56.0 | 2.7 | 68.2 | 17.2 | 2.1 | — | — | — | — |
| 3 | B | 1A | 10.2 | 52.8 | 2.4 | 65.4 | 22.8 | 2.3 | 74.8 | 2.3 | 77.1 | 0.3 |

Subsequently, the entire surface of the obtained valve seat insert was subjected to electrolytic copper plating treatment (copper sulfate bath) to form a pure Cu plating film. In some cases, electrolytic tin plating treatment (sulfate bath) was performed to form a tin plating film. Some valve seat inserts were not subjected to the plating treatment.

After the formation of the plating film, the plating film on the valve contacting face was removed by cutting, and a plating film was formed on the outer peripheral surface, the seating face, and some parts of the inner peripheral surface as shown in FIG. 1 to obtain a valve seat insert (product). The film thickness of the plating film was changed to the range shown in Table 7. The hardness of the plating film was changed by changing electrolytic treatment conditions. Further, the cross section of the obtained valve seat insert (product) was polished and subjected to nital etching, and the structure was observed using an optical microscope (magnification: 200 times) to obtain a ratio (vol %) of the functional member side layer in each valve seat insert. Furthermore, the cross section of the obtained valve seat insert (product) was polished and subjected to nital etching, and the hardness HV of the plating film was measured using a Vickers hardness tester (load: 20 g). The hardness HV of the cylinder head (equivalent material) was also measured in the same manner. The obtained results are shown in Table 7.

Figure 2:
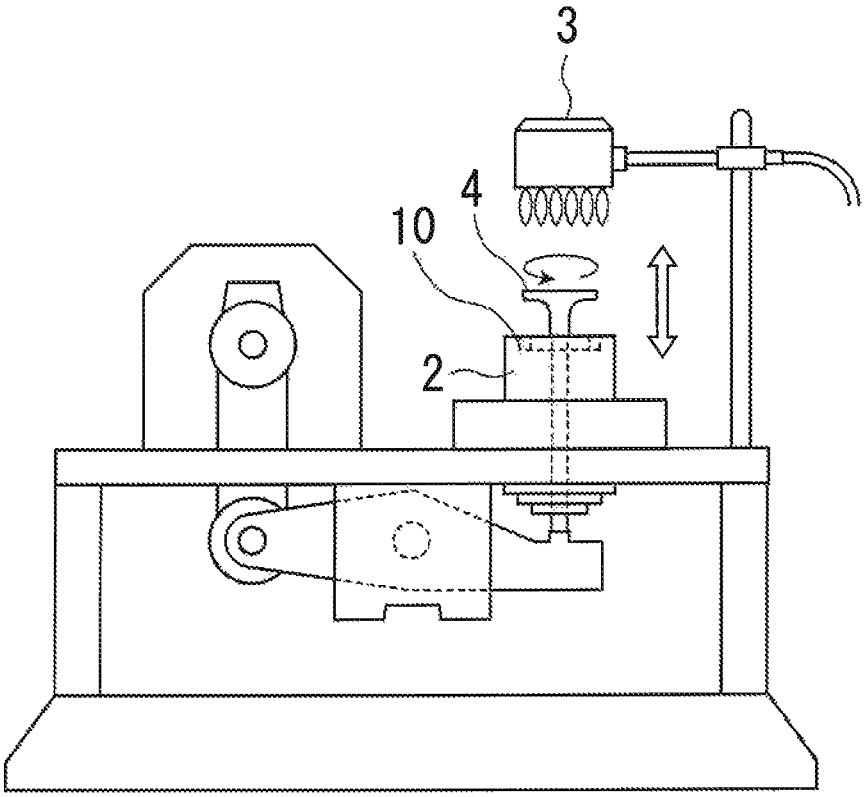
FIG. 2 is an explanatory view schematically showing the overview of a single piece rig testing machine used in Examples.

Using the obtained valve seat inserts as test pieces, they were mounted on a single rig wear testing machine shown in FIG. 2, and a wear test was performed under the following conditions:

Test temperature: 270° C.,

Test period: 8 hr,

Cam rotations: 3000 rpm,

Valve rotations: 20 rpm,

Valve material: Nitrided valve, and

Heat source: LPG.

A difference between before and after the wear test was calculated from the shape of a test piece (a valve seat insert) before and after the wear test and converted into a wear amount (μm). Taking the wear amount of a valve seat insert No. 1 (standard) as 1.00 (standard), the wear ratio of each valve seat insert to that is calculated, and the results are shown in Table 7. Cases where the valve seat insert wear ratio was equal to or less than the standard (1.00) were evaluated as "o", and other cases were evaluated as "x".

A sample for heat dissipation property investigation was produced under the same conditions as the above-mentioned valve seat insert, and the heat dissipation property of the valve seat insert was investigated using the obtained valve seat insert (product) as a test piece.

The heat dissipation property test was as follows.

Figure 3:
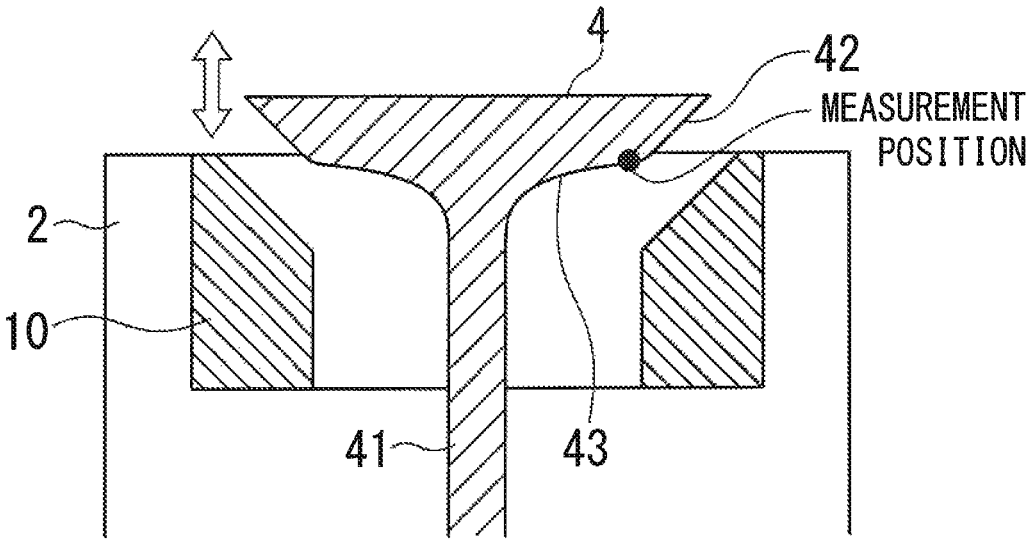
FIG. 3 is an explanatory view schematically showing a measurement position of a valve temperature in Examples.

The obtained valve seat insert was mounted on the single piece rig testing machine shown in FIG. 2 and heated to a predetermined temperature. While the valve and the valve seat insert were brought into contact under the following conditions, as shown in FIG. 3, a valve temperature was measured at a position near the valve-contacting face side of a slope 43 connecting an outer peripheral surface of a valve shaft 41 and a valve face surface 42. A thermocouple was used for temperature measurement. The heat source was adjusted so that the temperature of the seating face of the valve seat insert No. 1 was 250° C., and each valve seat insert was heated. The comparison was made at a temperature after a lapse of 1 hour after the start of the test.

Cam rotations: 1000 rpm,
Valve rotations: None,
Valve material: Nitrided valve, and
Heat source: LPG.

From the obtained measurement results, using the valve seat insert No. 1 (without plating film) as a standard, a change amount ΔT of the valve temperature due to the valve seat insert (=(valve temperature due to the valve seat insert)−(valve temperature due to valve seat insert No. 1) is calculated and shown in Table 7 together.

In all the examples of the present invention, ΔT is negative, and it can be seen that the heat dissipation property is superior to that of the standard valve seat insert (without plating film), and an excellent wear resistance equivalent to that of the standard valve seat insert is provided. On the other hand, in a comparative example, which is out of the scope of the present invention, a desired excellent heat dissipation property is not obtained.

TABLE 7

| Valve seat insert No. | Sintered body No* | Functional member side layer ratio actual measurement value (volume %) | Plating film: Film type** | Film thickness (μm) | Hardness (Hv) | Formation position*** | Surface roughness Ra (μm) |
|---|---|---|---|---|---|---|---|
| 1 | 1 | 42 | — | — | — | — | — |
| 2 | 1 | 37 | 1 | 1.2 | 175.1 | 1 | 0.35 |
| 3 | 1 | 52 | 1 | 11.4 | 182.2 | 1 | 0.28 |
| 4 | 1 | 50 | 1 | 24.5 | 183.5 | 1 | 0.21 |
| 5 | 1 | 47 | 1 | 52.4 | 174.1 | 1 | 0.27 |
| 6 | 1 | 48 | 1 | 155.4 | 189.7 | 1 | 0.19 |
| 7 | 1 | 52 | 1 | 50.4 | 101.2 | 1 | 0.25 |
| 8 | 1 | 44 | 1 | 52.3 | 212.5 | 1 | 0.26 |
| 9 | 1 | 46 | 1 | 51.2 | 262.1 | 1 | 0.32 |
| 10 | 1 | 42 | 1 | 48.6 | 285.3 | 1 | 0.28 |
| 11 | 1 | 44 | 1 | 49.2 | 174.8 | 2 | 0.32 |
| 12 | 1 | 47 | 1 | 48.5 | 172.3 | 3 | 0.35 |
| 13 | 1 | 52 | 1 | 51.2 | 182.4 | 1 | 1.02 |
| 14 | 2 | 100 | 1 | 49.5 | 174.2 | 1 | 0.32 |
| 15 | 3 | 43 | 1 | 35.0 | 173.4 | 1 | 0.28 |
| 16 | 1 | 45 | 2 | 11.3 | 92.0 | 1 | 0.24 |
| 17 | 1 | 43 | 1 | 41.0 | 122.1 | 1 | 0.27 |
| 18 | 1 | 41 | 1 | 42.0 | 75.0 | 1 | 0.36 |
| 19 | 1 | 47 | 1 | 38.4 | 93.0 | 1 | 0.32 |
| 20 | 1 | 42 | 1 | 8.2 | 123.0 | 1 | 0.27 |
| 21 | 1 | 39 | 1 | 10.2 | 134.2 | 1 | 0.25 |

| Valve seat insert No. | Cylinder head hardness (Hv) | Hardness ratio**** | Heat dissipation property: Temperature difference ΔT (° C.) | Evaluation | Wear resistance: Wear ratio | Evaluation | Remarks |
|---|---|---|---|---|---|---|---|
| 1 | 92 | — | 0 (reference) | — | 1 | — | Conventional example |
| 2 | 89 | 1.97 | −56 | ○ | 0.95 | ○ | Inventive example |
| 3 | 86 | 2.12 | −60 | ○ | 0.89 | ○ | Inventive example |
| 4 | 87 | 2.11 | −72 | ○ | 0.96 | ○ | Inventive example |
| 5 | 88 | 1.98 | −86 | ○ | 0.95 | ○ | Inventive example |
| 6 | 81 | 2.34 | −10 | X | 0.98 | ○ | Comparative example |
| 7 | 97 | 1.04 | −19 | X | 0.91 | ○ | Comparative example |
| 8 | 91 | 2.34 | −42 | ○ | 0.92 | ○ | Inventive example |
| 9 | 67 | 3.91 | −30 | ○ | 0.89 | ○ | Inventive example |
| 10 | 62 | 4.60 | −10 | X | 1.00 | ○ | Comparative example |
| 11 | 85 | 2.06 | −82 | ○ | 0.98 | ○ | Inventive example |
| 12 | 92 | 1.87 | −70 | ○ | 0.94 | ○ | Inventive example |
| 13 | 86 | 2.12 | −15 | X | 0.94 | ○ | Comparative example |
| 14 | 82 | 2.12 | −68 | ○ | 0.95 | ○ | Inventive example |
| 15 | 82 | 2.11 | −70 | ○ | 0.45 | ○ | Inventive example |
| 16 | 84 | 1.10 | −45 | ○ | 0.97 | ○ | Inventive example |
| 17 | 86 | 1.42 | −68 | ○ | 0.96 | ○ | Inventive example |
| 18 | 67 | 1.12 | −40 | ○ | 0.98 | ○ | Inventive example |
| 19 | 87 | 1.07 | −55 | ○ | 0.94 | ○ | Inventive example |
| 20 | 86 | 1.43 | −76 | ○ | 0.98 | ○ | Inventive example |
| 21 | 85 | 1.58 | −78 | ○ | 0.96 | ○ | Inventive example |

*See Table 5 and Table 6

**1: Copper plating, 2: Tin plating

***1: Outer peripheral surface + seating face + inner peripheral surface, 2: Outer peripheral surface + seating face, 3: Outer peripheral portion

****Plating film hardness/cylinder head hardness

Example 2

As raw-material powders, the raw-material powders (an iron-based powder, a graphite powder, a powder for alloying elements, a hard particle powder, a solid lubricant particle powder) shown in Table 8 were blended in the blend amounts shown in Table 8, mixed and kneaded to afford a mixed powder for functional member side layer. As raw-material powders, the raw-material powders (an iron-based powder, a graphite powder, a powder for alloying elements, a hard particle powder, a solid lubricant particle powder) shown in Table 9 were blended in the blend amounts shown in Table 9, mixed and kneaded to afford a mixed powder for supporting member side layer. The compositions of various iron-based powders used are shown in Table 3, and the compositions of various hard particle powders used are shown in Table 4.

TABLE 8

| | For functional member side layer | | | | |
|---|---|---|---|---|---|
| Mixed powder No. | Metal powder Type*: blend amount (mass %) | Graphite powder Blend amount (mass %) | Alloy element powder Blend amount (mass %) | Hard particle powder Type**: blend amount (mass %) | Solid lubricant particle powder Type***: blend amount (mass %) |
| A | a: 62.8, b: 10 | 1.1 | Nr 1.6, Co: 2.5 | HP1: 20 | SL1: 2 |
| C | b: 64.1 | 0.9 | Co: 3.0 | HP2: 30 | SL1: 2 |
| D | a: 94.7 | 1.1 | Ni: 0.2, Cu: 2.5 | HP3: 1.0 | SL1: 0.5 |

*See Table 3
**See Table 4
***SL1: MnS

TABLE 9

| | For supporting member side layer | | | | |
|---|---|---|---|---|---|
| Mixed powder No. | Iron-based powder Type*: blend amount (mass %) | Graphite powder Blend amount (mass %) | Alloy element powder Blend amount (mass %) | Hard particle powder Type**: blend amount (mass %) | Solid lubricant particle powder Type***: blend amount (mass %) |
| 1A | c: 95.25 | 0.92 | Ni: 0.33, Cu: 2.71 | HP3: 0.79 | SL1: 0.5 |
| 1B | c: 94.35 | 1.05 | Ni: 0.4, Cu: 3.2 | HP3: 1.0 | — |

*See Table 3
**See Table 4
***SL1: MnS

Next, these mixed powders obtained were integrally pressure molded (face pressure: 5.0 to 10.0 ton/cm$^2$) with a press molding machine, and thus two-layered green compacts for valve seat insert were obtained.

The obtained green compacts were further subjected to a 1P1S step of sintering treatment (heating temperature: 1000 to 1300° C.) to afford sintered bodies.

The obtained sintered bodies were cut and ground to afford a valve seat insert with an outer diameter of 27.1 mmφ, an inner diameter of 22.0 mmφ, and a thickness of 6.5 mm. A target surface roughness of the valve seat insert was 0.2 μm in Ra.

For each of the layers of the valve seat inserts obtained, the contents of the respective compositions were analyzed by emission analysis, and thus the composition of each layer was measured. The obtained results are shown in Table 10. Further, the cross sections of the obtained valve seat inserts were polished, and the structure was observed and imaged using an optical microscope (magnification: 200 times). Image analysis was used to measure the structural fractions of the matrix phase, hard particles, and solid lubricant particles in each layer. The obtained results are shown in Table 11.

TABLE 10

| | | | Sintered body chemical composition (mass %) | | | | | | | | | | | | | | | |
|---|---|---|---|---|---|---|---|---|---|---|---|---|---|---|---|---|---|---|
| | | | | | | | | | | | | | | Supporting member side layer | | | | |
| | Mixed powder No.* | | | | | | | | | | | | | | Others | | | |
| | Functional | Supporting | Functional member side layer | | | | | | | | | | | | Mo, Si, Cr, | | | |
| Sintered | member | member | | Others | | | | | | | | | | | Ni, Mn, W, | | | |
| body No. | side layer | side layer | C | Co | Ni | Mo | Cr | Mn | S | W | V | Others | Total | Balance | C | V, S, Cu | Total | Balance |
| 4 | A | 1A | 1.1 | 10.4 | 3.6 | 5.3 | 5.4 | 1.2 | 0.8 | 0.6 | 0.2 | 1.4 | 28.9 | Fe | 1.1 | Mo: 0.6, Cu: 4.2, Mn: 0.3, S: 0.2, Ni: 0.3 | 5.6 | Fe |

TABLE 10-continued

| | Mixed powder No.* | | Sintered body chemical composition (mass %) | | | | | | | | | | | | | | | |
|---|---|---|---|---|---|---|---|---|---|---|---|---|---|---|---|---|---|---|
| | | | Functional member side layer | | | | | | | | | | | Supporting member side layer | | | | |
| | | | | | | | | | | | | | | | Others | | | |
| Sintered body No. | Functional member side layer | Supporting member side layer | C | Co | Ni | Mo | Cr | Mn | S | W | V | Others | Total | Balance | C | Mo, Si, Cr, Ni, Mn, W, V, S, Cu | Total | Balance |
| 5 | A | — | 1.2 | 10.2 | 3.2 | 5.8 | 5.6 | 1.2 | 0.8 | 0.6 | 0.2 | 1.2 | 28.2 | Fe | — | — | — | — |
| 6 | C | 1B | 1.2 | 19.4 | — | 11.3 | 5.1 | 1.3 | 0.7 | 3.5 | 1.0 | 1.5 | 43.8 | Fe | 1.2 | Mo: 0.6, Cu: 42 | 4.8 | Fe |
| 7 | D | — | 1.1 | — | 0.1 | 0.5 | — | 0.4 | 0.1 | — | — | 3.8 | 4.9 | Fe | — | — | — | — |

*See Table 8 and Table 9

TABLE 11

| | Mixed powder No.* | | Sintered body structure (volume %) | | | | | | | | | |
|---|---|---|---|---|---|---|---|---|---|---|---|---|
| | | | Functional member side layer | | | | | | Supporting member side layer | | | |
| | | | Matrix phase (volume %) | | | | | | Matrix phase (volume %) | | | |
| Sintered body No. | Functional member side layer | Supporting member side layer | Fine carbide precipitation phase | Pearlite phase | Others | Total | Hard particles (volume %) | Solid lubricant particle (volume %) | Pearlite phase | Others | Total | Solid lubricant particle (volume %) |
| 4 | A | 1A | 10.1 | 53.4 | 3.4 | 66.9 | 15.2 | 1.8 | 78.2 | 1.7 | 79.9 | 0.5 |
| 5 | A | — | 10.5 | 58.4 | 2.2 | 71.1 | 16.8 | 2.2 | — | — | — | — |
| 6 | C | 1B | 57.7 | — | 4.7 | 62.4 | 24.1 | 1.9 | 72.5 | 3.5 | 76.0 | — |
| 7 | D | — | — | 82.3 | 2.2 | 84.5 | 1.2 | 0.3 | — | — | — | — |

*See Table 8 and Table 9

Subsequently, the obtained valve seat inserts (sintered body No. 4 and sintered body No. 5) were subjected to a vacuum impregnation treatment using a heat curing type resin, and the sealing hole treatment was performed. In the sealing hole treatment, the valve seat insert was immersed in the above-mentioned resin liquid in a vacuum atmosphere. Then, in an atmospheric pressure atmosphere, the pores of the valve seat insert were sufficiently impregnated with the resin and further heated to cure the resin in the pores, and thus to seal the pores. The resin used was a heat curing type resin (Resinol 90C: trade name, manufactured by Henkel AG & Co. KGaA) heat-cured at 85 to 90° C. Most of the pores contained in the sintered body (valve seat insert) were sealed by the sealing hole treatment. Some valve seat inserts No. A1 and No. A2 were not subjected to the sealing hole treatment.

The entire surface of the obtained valve seat insert (sintered body No. 4) was then subjected to electrolytic copper plating treatment to form a copper plating film. After the formation of the plating film, the plating film on the valve contacting face was removed by cutting to obtain valve seat inserts (products) Nos. A2 to A11 in which a plating film was formed on the outer peripheral surface, the seating face, and some parts of the inner peripheral surface as shown in FIG. 1. The film thickness of the plating film was changed to the range shown in Table 12 by changing the electrolytic treatment conditions. The valve seat insert No. A1 was not subjected to the plating treatment. Further, the cross section of the obtained valve seat insert (product) was polished, and the ratio of the functional member side layer in the valve seat insert was obtained using an optical microscope (magnification: 200 times). Furthermore, the cross section of the obtained valve seat insert (product) was polished and subjected to nital etching, and the hardness HV of the plating film was measured using a Vickers hardness tester (load: 10 g). The hardness HV of the cylinder head (equivalent material) was also measured in the same manner.

Using the obtained valve seat inserts as test pieces, they were mounted on the single rig wear testing machine shown in FIG. 2, and a wear test was performed as in Example 1.

A difference between before and after the wear test was calculated from the shape of a test piece (a valve seat insert) before and after the wear test and converted into a wear amount (μm). Taking the wear amount of a valve seat insert No. A1 (standard) as 1.00 (standard), the wear ratio of each valve seat insert to that is calculated, and the results are shown in Table 12. Cases where the valve seat insert wear ratio was equal to or less than the standard (1.00) were evaluated as "o", and other cases were evaluated as "x".

A sample for heat dissipation property investigation was produced under the same conditions as the above-mentioned valve seat insert, and the heat dissipation property of the valve seat insert was investigated using the obtained valve seat insert (product) as a test piece.

The heat dissipation property test was the same as in Example 1.

From the obtained measurement results, using the valve seat insert No. A1 (without plating film) as a standard, the change amount ΔT of the valve temperature due to the valve seat insert (=(valve temperature due to the valve seat insert)−(valve temperature due to valve seat insert No. A1) is calculated and shown in Table 12 together.

TABLE 12

| Valve seat insert No. | Sintered body No* | Functional member side layer ratio actual measurement value (volume %) | Sealing hole treatment | Plating film: Film type** | Film thickness (μm) | Hardness (Hv) | Formation position*** | Surface roughness Ra (μm) |
|---|---|---|---|---|---|---|---|---|
| A1 | 4 | 38 | No | — | — | — | — | — |
| A2 | 4 | 48 | No | 1 | 10.2 | 132.0 | 1 | 0.28 |
| A3 | 4 | 49 | Yes | 1 | 12.3 | 128.4 | 1 | 0.29 |
| A4 | 4 | 49 | Yes | 1 | 26.2 | 148.7 | 1 | 0.25 |
| A5 | 4 | 47 | Yes | 1 | 50.4 | 147.5 | 1 | 0.27 |
| A6 | 4 | 48 | Yes | 1 | 98.5 | 144.8 | 1 | 0.35 |
| A7 | 4 | 42 | Yes | 1 | 158.0 | 152.3 | 1 | 0.41 |
| A8 | 4 | 44 | Yes | 1 | 15.2 | 98.3 | 1 | 0.36 |
| A9 | 4 | 45 | Yes | 1 | 13.2 | 290.3 | 1 | 0.62 |
| A10 | 4 | 39 | Yes | 1 | 16.9 | 262.1 | 1 | 0.32 |
| A11 | 5 | 100 | Yes | 1 | 13.6 | 137.9 | 1 | 0.28 |

| Valve seat insert No. | Cylinder head hardness (Hv) | Hardness ratio**** | Heat dissipation property: Temperature difference ΔT (° C.) | Evaluation | Wear resistance: Wear ratio | Wear ratio | Remarks |
|---|---|---|---|---|---|---|---|
| A1 | 86 | — | 0 (reference) | — | 1 | — | Conventional example |
| A2 | 86 | 1.53 | −70 | ○ | 0.98 | ○ | Inventive example |
| A3 | 85 | 1.51 | −72 | ○ | 0.95 | ○ | Inventive example |
| A4 | 87 | 1.71 | −68 | ○ | 0.95 | ○ | Inventive example |
| A5 | 82 | 1.80 | −73 | ○ | 0.98 | ○ | Inventive example |
| A6 | 85 | 1.70 | −68 | ○ | 0.95 | ○ | Inventive example |
| A7 | 85 | 1.79 | −10 | X | 0.95 | ○ | Comparative example |
| A8 | 101 | 0.97 | −9 | X | 0.96 | ○ | Comparative example |
| A9 | 85 | 3.42 | −35 | ○ | 0.98 | ○ | Inventive example |
| A10 | 52 | 5.04 | −5 | X | 0.91 | ○ | Comparative example |
| A11 | 87 | 1.59 | −65 | ○ | 0.96 | ○ | Inventive example |

*See Table 10 and Table 11

**1: Copper plating

***1: Outer peripheral surface seating face + inner peripheral surface

****Plating film hardness/cylinder head hardness

In all the examples of the present invention, ΔT is negative, and it can be seen that the heat dissipation property is superior to that of the standard valve seat insert (without plating film), and an excellent wear resistance equivalent to that of the standard valve seat insert is provided. On the other hand, in a comparative example, which is out of the scope of the present invention, a desired excellent heat dissipation property is not obtained. From comparison between the valve seat insert No. A2 (with plating film, without sealing hole treatment) and the valve seat insert No. A3 (with plating film, with sealing hole treatment), no effect of sealing hole treatment on the heat dissipation property and the wear resistance was observed.

Example 3

Using a mixed powder No. C for the functional member side layer shown in Table 8 and a mixed powder No. 1B for the supporting member side layer shown in Table 9, these mixed powders were integrally pressure molded (face pressure: 5.0 to 10.0 ton/cm$^2$) with a press molding machine to obtain a green compact for valve seat insert having a two-layer structure. In addition, using the mixed powder No. D for the functional member side layer shown in Table 8, the mixed powder was pressure molded (face pressure: 5.0 to 10.0 ton/cm$^2$) with a press molding machine to obtain a green compact for valve seat inserts with a single-phase structure. The obtained green compacts were further subjected to the 1P1S step of sintering treatment (heating temperature: 1000 to 1300° C.) to afford sintered bodies No. 6 (two-layer structure) and No. 7 (single layer structure).

The obtained sintered bodies were cut and ground to afford a valve seat insert with an outer diameter of 27.1 mmφ, an inner diameter of 22.0 mmφ, and a thickness of 6.5 mm. A target surface roughness of the valve seat insert was 0.2 μm in Ra. The composition and structure of the obtained valve seat insert (sintered bodies No. 6 and No. 7) were measured as in Example 2 and shown in Tables 10 and 11 together.

Subsequently, as in Example 2, the obtained valve seat inserts (sintered bodies No. 6 and No. 7) were subjected to a vacuum impregnation treatment using a heat curing type resin, and the sealing hole treatment was performed. In the sealing hole treatment, as in Example 2, the valve seat insert was immersed in the resin liquid in a vacuum atmosphere. Then, in an atmospheric pressure atmosphere, the pores of the valve seat insert were sufficiently impregnated with the resin and further heated to cure the resin in the pores, and thus to seal the pores. The resin used was a heat curing type resin, and Resinol 90C (trade name: manufactured by Henkel AG & Co. KGaA) heat-cured at 85 to 90° C. was used. Most of the pores contained in the sintered body (valve seat insert) were sealed by the sealing hole treatment. Some valve seat inserts No. B1 and No. C1 were not subjected to the sealing hole treatment.

The entire surface of the obtained valve seat inserts (sintered bodies No. 6 and No. 7) was subjected to electrolytic copper plating treatment as in Example 2 to form a copper plating film. After the formation of the plating film, the plating film on the valve contacting face was removed by cutting to obtain valve seat inserts (products) Nos. B2 to B4 and Nos. C2 to C4 in which a plating film was formed on the outer peripheral surface, the seating face, and some parts of the inner peripheral surface as shown in FIG. 1. Some valve seat inserts Nos. B1 and C1 were not subjected to the plating treatment. Further, the cross section of the obtained valve seat insert (product) was polished, and the ratio of the functional member side layer in the valve seat insert was obtained using an optical microscope (magnification: 200 times). Furthermore, the cross section of the obtained valve seat insert (product) was polished and subjected to nital etching, and the hardness HV of the plating film was measured using a Vickers hardness tester (load: 10 g). The hardness HV of the cylinder head (equivalent material) was also measured in the same manner.

Using the obtained valve seat inserts as test pieces, they were mounted on the single rig wear testing machine shown in FIG. 2, and a wear test was performed as in Example 2.

A difference between before and after the wear test was calculated from the shape of a test piece (a valve seat insert) before and after the wear test and converted into a wear amount (μm). Taking the wear amounts of valve seat inserts No. B1 (standard) and No. C1 as 1.00 (standard), the wear ratio of each valve seat insert to that is calculated, and the results are shown in Table 13 and Table 14. Cases where the valve seat insert wear ratio was equal to or less than the standard (1.00) were evaluated as "o", and other cases were evaluated as "x".

A sample for heat dissipation property investigation was produced under the same conditions as the above-mentioned valve seat insert, and the heat dissipation property of the valve seat insert was investigated using the obtained valve seat insert (product) as a test piece.

The heat dissipation property test was the same as in Example 2.

From the obtained measurement results, using the valve seat insert No. B1 (without plating film) as a standard, the change amount ΔT of the valve temperature due to the valve seat insert (=(valve temperature due to the valve seat insert)−(valve temperature due to valve seat insert No. B1) is calculated and shown in Table 13 together. Similarly, using the valve seat insert No. C1 (without plating film) as a standard, the change amount ΔT of the valve temperature due to the valve seat insert (=(valve temperature due to the valve seat insert)−(valve temperature due to valve seat insert No. C1) is calculated and shown in Table 14 together.

TABLE 13

| Valve seat insert No. | Sintered body No* | Functional member side layer ratio actual measurement value (volume %) | Sealing hole treatment | Plating film: Film type** | Film thickness (μm) | Hardness (Hv) | Formation position*** | Surface roughness Ra (μm) |
|---|---|---|---|---|---|---|---|---|
| B1 | 6 | 47 | No | — | — | — | — | — |
| B2 | 6 | 52 | Yes | 1 | 10.5 | 139.6 | 1 | 0.22 |
| B3 | 6 | 48 | Yes | 1 | 53.4 | 145.3 | 1 | 0.26 |
| B4 | 6 | 43 | Yes | 1 | 112.3 | 158.6 | 1 | 0.32 |

| Valve seat insert No. | Cylinder head hardness (Hv) | Hardness ratio**** | Heat dissipation property: Temperature difference ΔT (° C.) | Evaluation | Wear resistance: Wear ratio | Evaluation | Remarks |
|---|---|---|---|---|---|---|---|
| B1 | 84 | — | 0 (reference) | — | 1 | — | Conventional example |
| B2 | 89 | 1.57 | −64 | ○ | 0.96 | ○ | Inventive example |
| B3 | 87 | 1.67 | −65 | ○ | 0.98 | ○ | Inventive example |
| B4 | 85 | 1.87 | −61 | ○ | 0.94 | ○ | Inventive example |

*See Table 10 and Table 11

**1: Copper plating

***1: Outer peripheral surface + seating face + inner peripheral surface

****Plating film hardness/cylinder head hardness

TABLE 14

| Valve seat insert No. | Sintered body No* | Functional member side layer ratio actual measurement value (volume %) | Sealing hole treatment | Plating film: Film type** | Film thickness (μm) | Hardness (Hv) | Formation position*** | Surface roughness Ra (μm) |
|---|---|---|---|---|---|---|---|---|
| C1 | 7 | 45 | No | — | — | — | — | — |
| C2 | 7 | 46 | Yes | 1 | 12.3 | 142.5 | 1 | 0.25 |

TABLE 14-continued

| | | | | | | | | |
|---|---|---|---|---|---|---|---|---|
| C3 | 7 | 41 | Yes | 1 | 47.6 | 139.8 | 1 | 0.24 |
| C4 | 7 | 43 | Yes | 1 | 125.7 | 159.2 | 1 | 0.34 |

| | Cylinder head | | Heat dissipation property | | Wear resistance | | |
|---|---|---|---|---|---|---|---|
| | | | Temperature | | | | |
| Valve seat insert No. | hardness (Hv) | Hardness ratio**** | difference ΔT (° C.) | Evaluation | Wear ratio | Evaluation | Remarks |
| C1 | 89 | — | 0 (reference) | — | 1 | — | Conventional example |
| C2 | 87 | 1.64 | −59 | ○ | 0.95 | ○ | Inventive example |
| C3 | 87 | 1.61 | −58 | ○ | 0.98 | ○ | Inventive example |
| C4 | 89 | 1.79 | −63 | ○ | 0.98 | ○ | Inventive example |

*See Table 10 and Table 11
**1: Copper plating
***1: Outer peripheral surface + seating face + inner peripheral surface
****Plating film hardness/cylinder head hardness In all the examples of the present invention, ΔT is negative, and it can be seen that the heat dissipation property is superior to that of the standard valve seat insert (without plating film), and an excellent wear resistance equivalent to that of the standard valve seat insert is provided. On the other hand, in a comparative example, which is out of the scope of the present invention, a desired excellent heat dissipation property is not obtained. Comparing the valve seat inserts No. B1 to No. B4 and the valve seat inserts No. C1 to No. C4, also in the case of the valve seat inserts No. B1 to No. B4 whose matrix composition is a high alloy composition, similarly, it can be seen that the heat dissipation property is superior to that of the standard valve seat insert (without plating film), and that the excellent wear resistance equivalent to that of the standard valve seat insert can be maintained.

Example 4

A sintered body was provided as in Example 2.

As raw-material powders, the raw-material powders (an iron-based powder, a graphite powder, a powder for alloying elements, a hard particle powder, a solid lubricant particle powder) shown in Table 8 were blended in the blend amounts shown in Table 8, mixed and kneaded to afford a mixed powder A for functional member side layer. Further, the raw-material powders (an iron-based powder, a graphite powder, a powder for alloying elements, a hard particle powder, and a solid lubricant particle powder) shown in Table 9 were blended in the blend amounts shown in Table 9, mixed and kneaded to afford a mixed powder 1A for supporting member side layer.

Next, these mixed powders obtained were integrally pressure molded (face pressure: 5.0 to 10.0 ton/cm$^2$) with a press molding machine, and thus two-layered green compacts for valve seat insert were obtained. The obtained green compacts were further subjected to the 1P1S step of sintering treatment (heating temperature: 1000 to 1300° C.) to afford a sintered body No. 4.

The obtained sintered body No. 4 was cut and ground to afford a valve seat insert with an outer diameter of 27.1 mmφ, an inner diameter of 22.0 mmφ, and a thickness of 6.5 mm. The surface roughness of the valve seat insert was 0.1 to 1.6 μm in Ra.

The composition and structure of each layer of the obtained valve seat insert were measured as in Example 2. Tables 10 and 11 show the composition and structure. Further, the cross section of the obtained valve seat insert (product) was polished and subjected to nital etching, and the structure was observed using an optical microscope (magnification: 200 times) to obtain the ratio (vol %) of the functional member side layer in each valve seat insert.

Subsequently, as in Example 2, the obtained valve seat inserts No. D2 to No. D4 (sintered body No. 4) were subjected to a vacuum impregnation treatment using a heat curing type resin, and the sealing hole treatment was performed. The valve seat insert No. D1 was not subjected to the sealing hole treatment.

Next, in the valve seat insert No. D2, the concave-convex mixed portion (roughened surface region) having the shape shown in FIG. 5 was formed at a central position in a height direction of the valve seat insert on the outer peripheral surface of the finished valve seat insert. The roughened surface region was formed so as to have a triangular shape in the press-fitting direction, and an apex angle α of an apex facing the press-fitting direction was 36.9°. The number of roughened surface regions was 5, and the area ratio of the roughened surface region was 1.61% in total with respect to the entire region of the outer peripheral surface. The roughened surface region was formed by laser beam irradiation treatment. In the laser beam irradiation treatment, the irradiation pattern, irradiation time, output, frequency, and the like of the laser beam were adjusted so as to obtain a roughened surface region having the above-mentioned desired surface shape. The peak height was about 30 μm, the valley depth was about 30 μm, and a protrusion pitch was 75 μm.

In the valve seat insert No. D3, as in Example 2, after a copper plating film having the film thickness shown in Table 15 was formed on the entire surface of the valve seat insert, as in No. D2, a roughened surface region was formed on the outer peripheral surface of the valve seat insert. In the valve seat insert No. D4, as in No. D2, after a roughened surface region was formed on the outer peripheral surface of the valve seat insert, as in Example 2, a copper plating film having the film thickness shown in Table 15 was formed on the entire surface of the valve seat insert. After the formation of the plating film, the plating film on the valve contacting face was removed by cutting, and a plating film was left on the outer peripheral surface, the seating face, and some parts of the inner peripheral surface.

The obtained valve seat inserts No. D1 to No. D4 were subjected to a wear test and a heat dissipation test as in Example 2, and the wear resistance and the heat dissipation property were evaluated. The obtained results are shown in Table 15.

Figure 4:
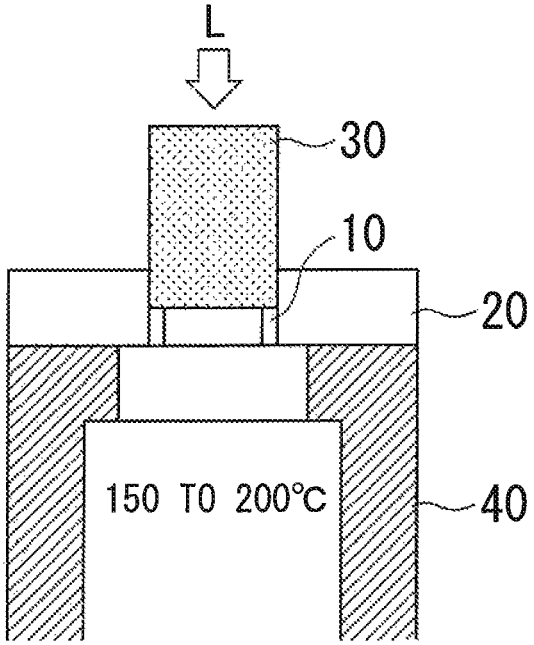
FIG. 4 is an explanatory view schematically showing an outline of high-temperature retaining force measuring equipment used in Examples.

With respect to the obtained valve seat inserts No. D1 to No. D4, the pull-out load at a predetermined temperature (200° C.) was measured using high-temperature retaining force measuring equipment shown in FIG. 4, and a high-temperature retaining force of the valve seat insert was evaluated. The valve seat insert 10 to be evaluated was press-fitted into an aluminum alloy cylinder head equivalent material 20. Then, the valve seat insert was heated to a predetermined temperature (200° C.) by heating means 40 provided below the cylinder head equivalent material 20. Then, the valve seat insert 10 heated to the predetermined temperature was pressed by using a pressing jig 30 and separated from the cylinder head equivalent material 20. A pull-out load L at that time was measured with a load meter (not shown). With respect to the obtained pull-out load, the pull-out load ratio of each valve seat insert was calculated with the valve seat insert No. D1 (conventional example) as a reference (1.00), and the falling out resistance property was evaluated. The obtained results are shown in Table 15.

TABLE 15

| Valve seat insert No. | Sintered body No* | Functional member side layer ratio actual measurement value (volume %) | Sealing hole treatment | Step** | Roughened surface region: Shape: Type | Roughened surface region: Shape: Shape | Roughened surface region: Area ratio*** (%) | Plating film Film type**** |
|---|---|---|---|---|---|---|---|---|
| D1 | 4 | 46 | No | — | — | — | — | — |
| D2 | 4 | 49 | Yes | 1 | Concave-convex mixed portion | FIG. 5 | 1.61 | — |
| D3 | 4 | 47 | Yes | 2 | Concave-convex mixed portion | FIG. 5 | 1.61 | 1 |
| D4 | 4 | 48 | Yes | 3 | Concave-convex mixed portion | FIG. 5 | 1.61 | 1 |

| Valve seat insert No. | Plating film: Film thickness (μm) | Plating film: Hardness (Hv) | Plating film: Formation position***** | Plating film: Surface roughness Ra (μm) | Cylinder head hardness (Hv) | Hardness ratio****** |
|---|---|---|---|---|---|---|
| D1 | — | — | — | — | 85 | — |
| D2 | — | — | — | — | 86 | — |
| D3 | 10.3 | 151.3 | 1 | 0.23 | 86 | 1.76 |
| D4 | 10.2 | 150.8 | 1 | 0.24 | 86 | 1.75 |

| Valve seat insert No. | Heat dissipation property: Temperature difference ΔT (° C.) | Heat dissipation property: Evaluation | Wear resistance: Wear ratio | Wear resistance: Evaluation | Pull-out load ratio | Remarks |
|---|---|---|---|---|---|---|
| D1 | 0 (reference) | — | 1 | — | 1.00 | Conventional example |
| D2 | +2 | X | 0.98 | ○ | 2.02 | Comparative example |
| D3 | −78 | ○ | 0.96 | ○ | 2.02 | Inventive example |
| D4 | −78 | ○ | 0.95 | ○ | 2.04 | Inventive example |

*See Table 10 and Table 11
**1: Surface roughening, 2: Plating ⇒ surface roughening, 3: Surface roughening ⇒ plating
***Ratio (%) to entire region of outer peripheral surface
****1: Copper plating
*****1: Outer peripheral surface + seating face + inner peripheral surface
******Plating film hardness/cylinder head hardness All the examples of the present invention have improved wear resistance, heat dissipation property, and falling out resistance property as compared with the standard valve seat insert No. D1 (without sealing hole treatment, plating film, and roughened surface region). On the other hand, in the comparative example (valve seat insert No. D2) outside the scope of the present invention, the heat dissipation property is lowered. The effect does not change regardless of which one of the plating film and the roughened surface region is formed first.

REFERENCE SIGNS LIST

2 setting jig
3 heat source
4 valve
10 valve seat insert
11 functional member side layer
12 supporting member side layer
13 plating film
20 cylinder head equivalent material
30 pressing jig
40 heating means
41 valve shaft
42 valve face surface
43 slope

The invention claimed is:

1. An iron-based sintered alloy valve seat insert for an internal combustion engine which is a valve seat insert for an internal combustion engine to be press-fitted into an aluminum alloy cylinder head, the valve seat insert made of an iron-based sintered alloy comprising:

a single layer of only a functional member side layer, or integrated two layers of the functional member side layer and a supporting member side layer, wherein a plating film is provided on at least an outer peripheral side, and a heat dissipation property is excellent, wherein the plating film is a plating film having a thickness of 1 to 100 μm and a hardness of 50 to 300 HV in a Vickers hardness HV, and the hardness of the plating film satisfies a range of 1.05 to 4.5 times a hardness of the cylinder head in the Vickers hardness HV, wherein the functional member side layer or the two layers of the functional member side layer and the supporting member side layer is/are layers formed by being subjected to a sealing hole treatment using a heat curing type resin or anaerobic resin, and wherein the plating film is a copper plating film or a tin plating film.

2. The iron-based sintered alloy valve seat insert for an internal combustion engine according to claim 1, wherein surface roughness of the plating film is 0.1 to 1.6 μm in arithmetic average roughness Ra in accordance with the provisions of JIS B 0601-1994.

3. The iron-based sintered alloy valve seat insert for an internal combustion engine according to claim 1, wherein a concave-convex mixed portion having, in a direction perpendicular to a circumferential direction, a plurality of rows of concave-convexes where concaves and convexes extending in the circumferential direction are adjacent to each other is provided as a roughened surface region at at least one portion on an outer peripheral surface of the valve seat insert, and the roughened surface region is provided at an area ratio of 0.3% or more in total with respect to an entire region of the outer peripheral surface.

4. The iron-based sintered alloy valve seat insert for an internal combustion engine according to claim 3, wherein when the concave-convex mixed portion is observed from a direction perpendicular to the outer peripheral surface, the concave-convex mixed portion has a triangular shape in a press-fitting direction, and an apex of the triangular shape facing the press-fitting direction has an apex angle of 10 to 150°.

5. The iron-based sintered alloy valve seat insert for an internal combustion engine according to claim 1, wherein when the two layers of the functional member side layer and the supporting member side layer are integrated, the functional member side layer is 10 to 70% by volume with respect to a total amount of the valve seat insert.

6. The iron-based sintered alloy valve seat insert for an internal combustion engine according to claim 1, wherein the functional member side layer has a matrix part in which hard particles are dispersed in a matrix phase, the matrix part has a matrix part composition containing C: 0.2 to 2.0% by mass and one kind or two or more kinds selected from among Co, Mo, Si, Cr, Ni, Mn, W, V, Cu, and S in a total amount of 50% by mass or less with the balance being Fe and unavoidable impurities, and a base matrix phase structure in which the hard particles are dispersed in the matrix phase in an amount of 5 to 40% by mass with respect to a total amount of the functional member side layer.

7. The iron-based sintered alloy valve seat insert for an internal combustion engine according to claim 1, wherein the supporting member side layer has a matrix part composition containing C: 0.2 to 2.0% by mass or further containing one kind or two or more kinds selected from among Mo, Si, Cr, Ni, Mn, W, V, S, P, and Cu in a total amount of 20% by mass or less with the balance being Fe and unavoidable impurities.

8. The iron-based sintered alloy valve seat insert for an internal combustion engine according to claim 6, wherein in addition to the base matrix phase structure, the functional member side layer further has a base matrix phase structure in which solid lubricant particles are dispersed in an amount of 0.5 to 4% by mass with respect to the total amount of the functional member side layer.

9. The iron-based sintered alloy valve seat insert for an internal combustion engine according to claim 7, wherein the supporting member side layer further has a structure in which solid lubricant particles are dispersed in the matrix phase in an amount of 0.5 to 4% by mass with respect to a total amount of the supporting member side layer.

10. The iron-based sintered alloy valve seat insert for an internal combustion engine according to claim 2, wherein a concave-convex mixed portion having, in a direction perpendicular to a circumferential direction, a plurality of rows of concave-convexes where concaves and convexes extending in the circumferential direction are adjacent to each other is provided as a roughened surface region at at least one portion on an outer peripheral surface of the valve seat insert, and the roughened surface region is provided at an area ratio of 0.3% or more in total with respect to an entire region of the outer peripheral surface.

* * * * *